US008342431B2

(12) United States Patent
Stein et al.

(10) Patent No.: US 8,342,431 B2
(45) Date of Patent: Jan. 1, 2013

(54) JET DIFFUSOR HAVING A WITHDRAWAL MECHANISM

(75) Inventors: Alexander Stein, Ihringen (DE); Wolf-Dieter Lacher, Mullheim (DE); Martin Fangmeier, Auggen (DE)

(73) Assignee: Neoperl GmbH, Mullheim (DE)

( * ) Notice: Subject to any disclaimer, the term of this patent is extended or adjusted under 35 U.S.C. 154(b) by 421 days.

(21) Appl. No.: 12/302,339

(22) PCT Filed: May 30, 2007

(86) PCT No.: PCT/EP2007/004788

§ 371 (c)(1), (2), (4) Date: Nov. 25, 2008

(87) PCT Pub. No.: WO2007/137836

PCT Pub. Date: Dec. 6, 2007

(65) Prior Publication Data

US 2009/0230671 A1 Sep. 17, 2009

(30) Foreign Application Priority Data

May 31, 2006 (DE) ..... 20 2006 008 625 U

(51) Int. Cl.

| | |
|---|---|
| ***B05B 1/00*** | (2006.01) |
| ***E03C 1/08*** | (2006.01) |
| ***E03C 1/00*** | (2006.01) |
| ***F16L 21/00*** | (2006.01) |

(52) U.S. Cl. ..... 239/600; 239/428.5; 285/8

(58) Field of Classification Search ..... 239/428.5, 239/600; 285/8

See application file for complete search history.

(56) References Cited

U.S. PATENT DOCUMENTS

| | | | | |
|---|---|---|---|---|
| 3,640,465 | A * | 2/1972 | Hicks | 239/583 |
| 4,304,426 | A * | 12/1981 | Francis | 285/323 |
| 6,513,731 | B2 * | 2/2003 | Griffin et al. | 239/394 |
| 7,216,820 | B2 * | 5/2007 | Nelson et al. | 239/451 |
| 7,357,337 | B2 * | 4/2008 | Ferrari | 239/428.5 |

FOREIGN PATENT DOCUMENTS

| | | |
|---|---|---|
| DE | 3817270 | 11/1989 |
| DE | 9317654.6 | 3/1994 |

* cited by examiner

*Primary Examiner* — Len Tran
*Assistant Examiner* — Ryan Reis
(74) *Attorney, Agent, or Firm* — Volpe and Koenig, P.C.

(57) ABSTRACT

A sanitary outlet fitting including a water outlet (2) and a jet regulator (1) which is associated with the water outlet and includes a jet regulator housing (3) with integrated components. The jet regulator housing can be inserted into the water outlet by an axial insertion movement and includes a holding element (6) provided with at least one radially mobile projection (10) for connecting to the water outlet. The outlet fitting includes either a locking element (8) that can be actuated from the outside without using a tool for selectively blocking and releasing the holding element, or an unlocking tool (65) can be inserted into the annular space (68) between the inner peripheral edge of the water outlet and the outer peripheral edge of the housing by an axial insertion movement. The insertion movement of the unlocking tool can be converted into a radial movement of the at least one projection of the holding element from a functional position into an unlocking position.

5 Claims, 15 Drawing Sheets

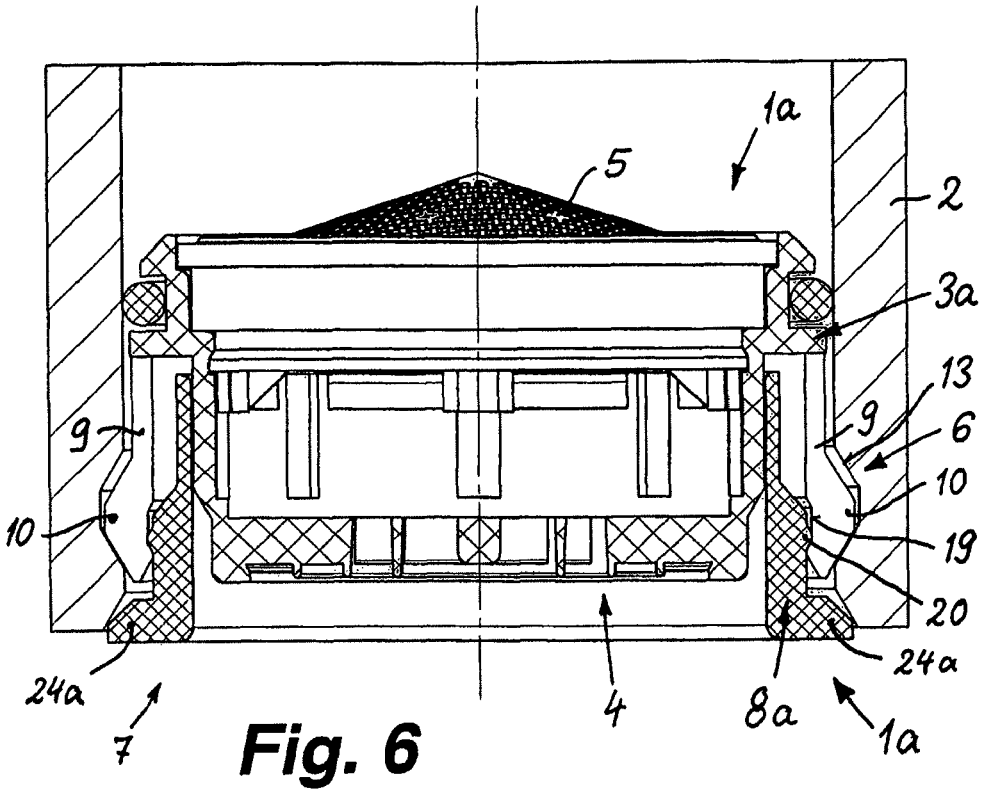
Fig. 6
Fig. 7
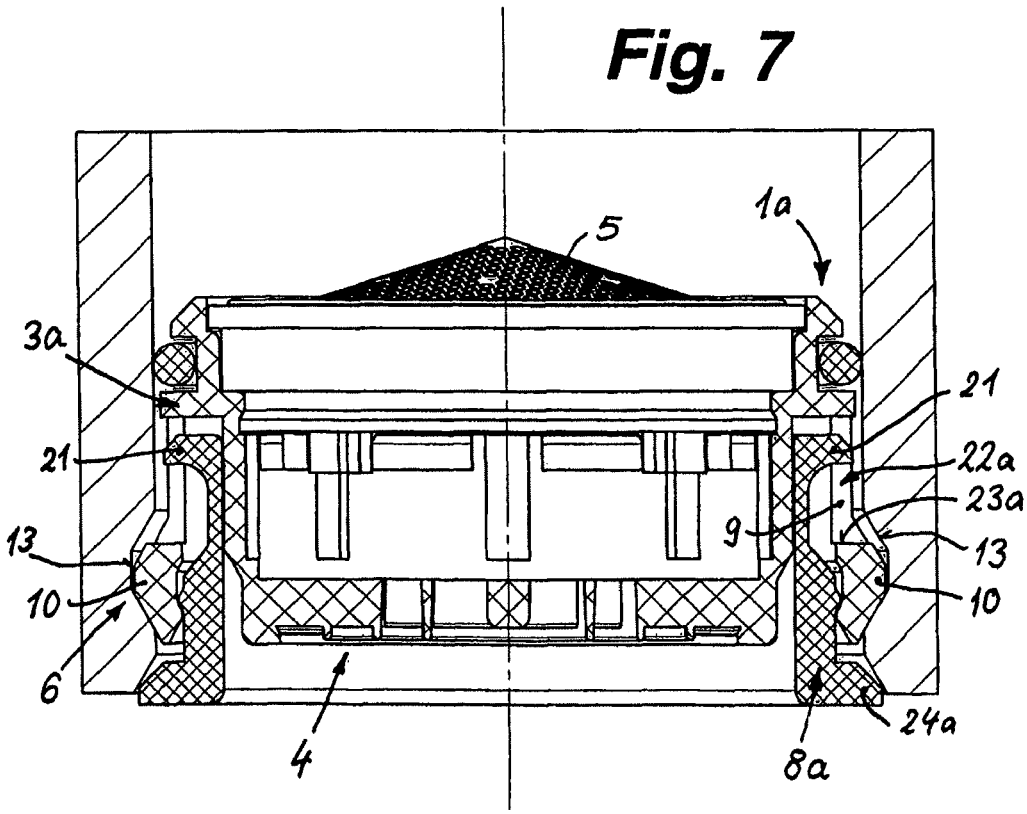

Fig.12
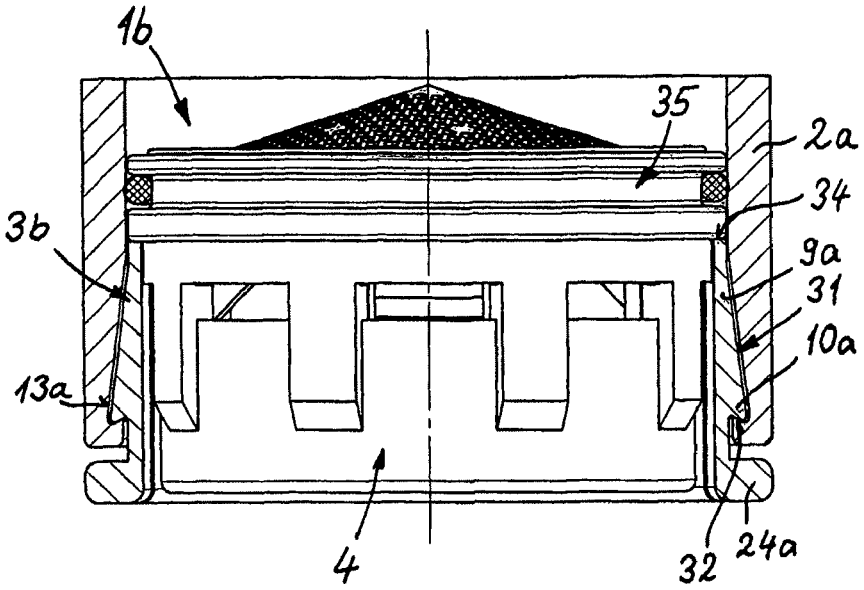
Fig.13a
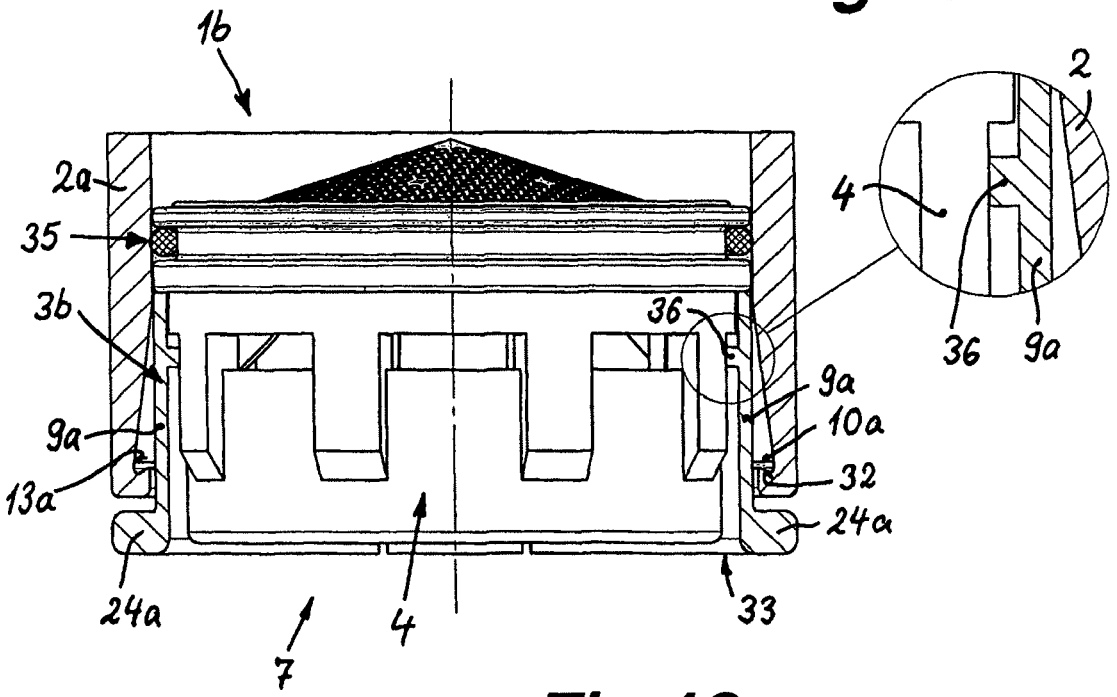
Fig.13

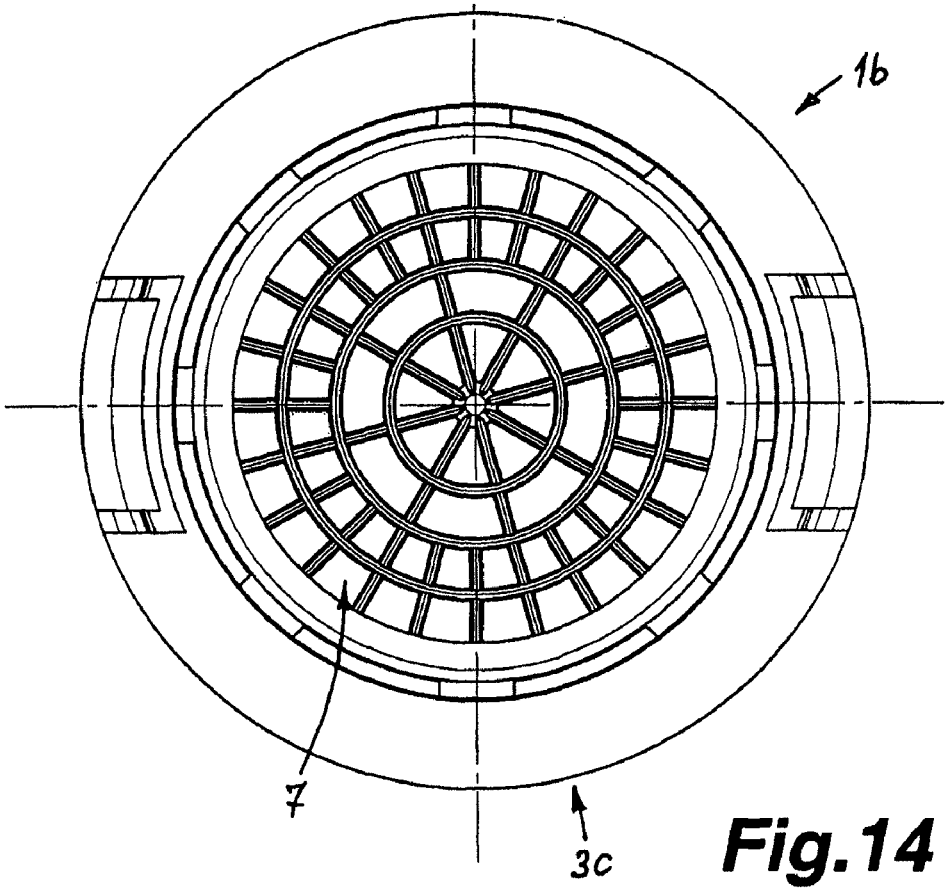
Fig.14
Fig.15
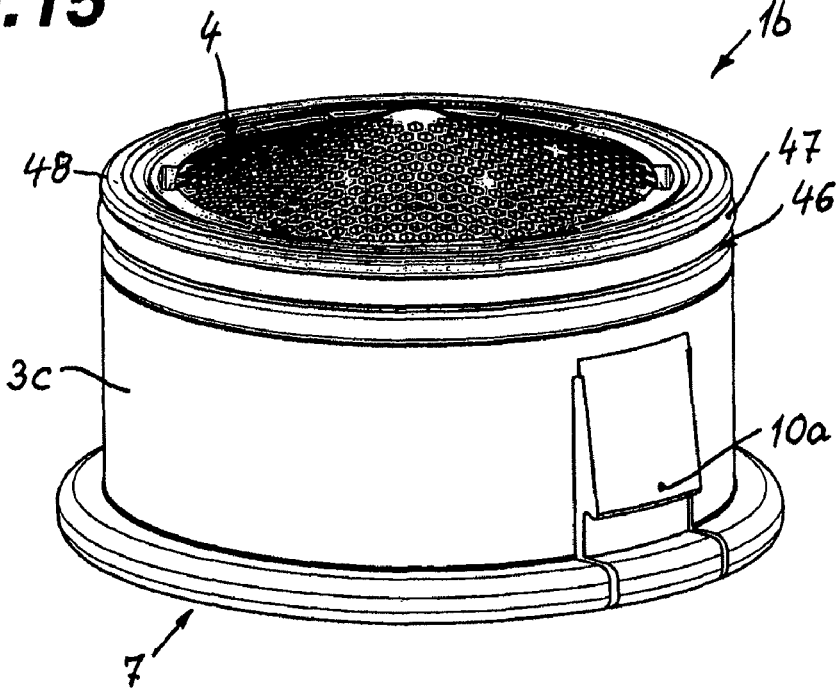

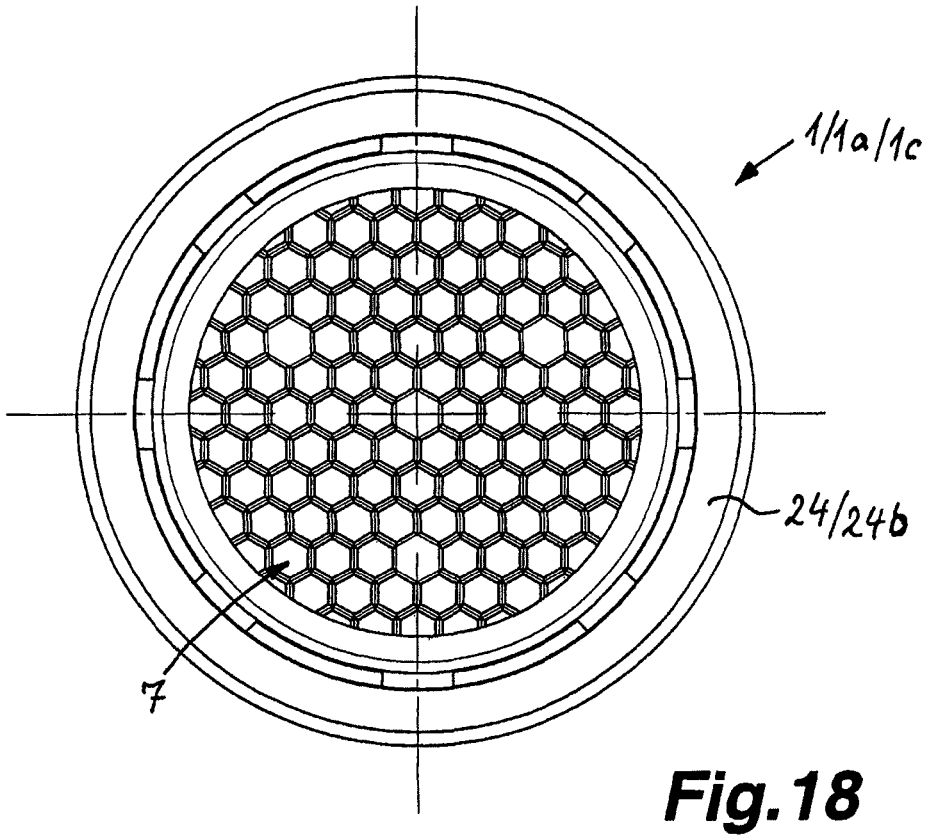
Fig.18
Fig.19
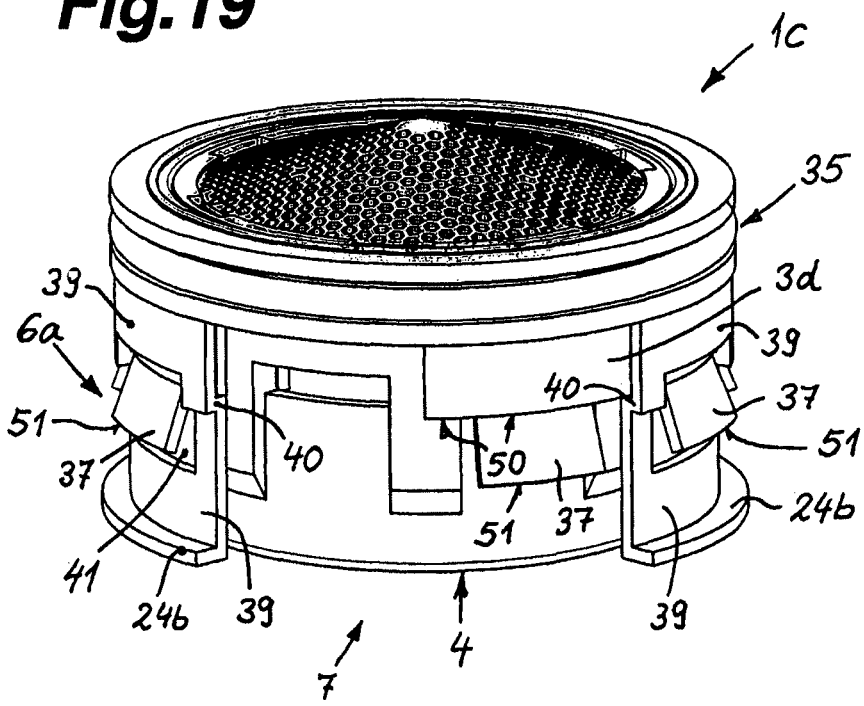

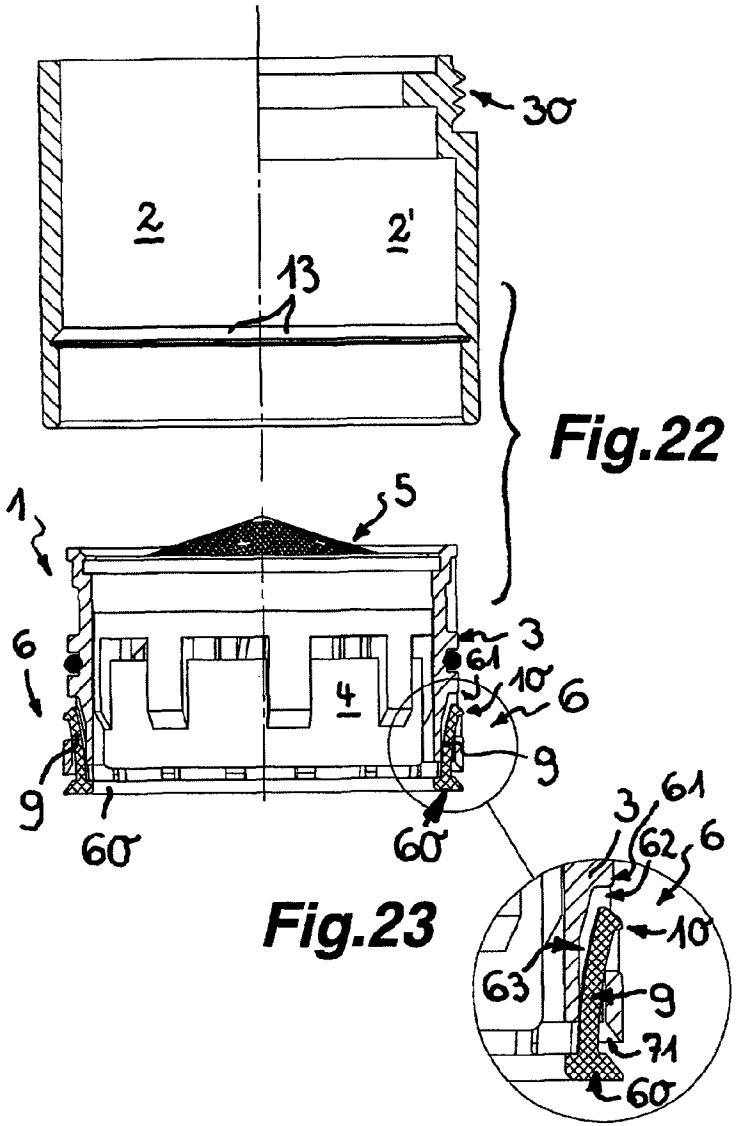
Fig.22
Fig.23
30
2'
2
13
5
4
1
3
61
10
6
9
60
62
63
74
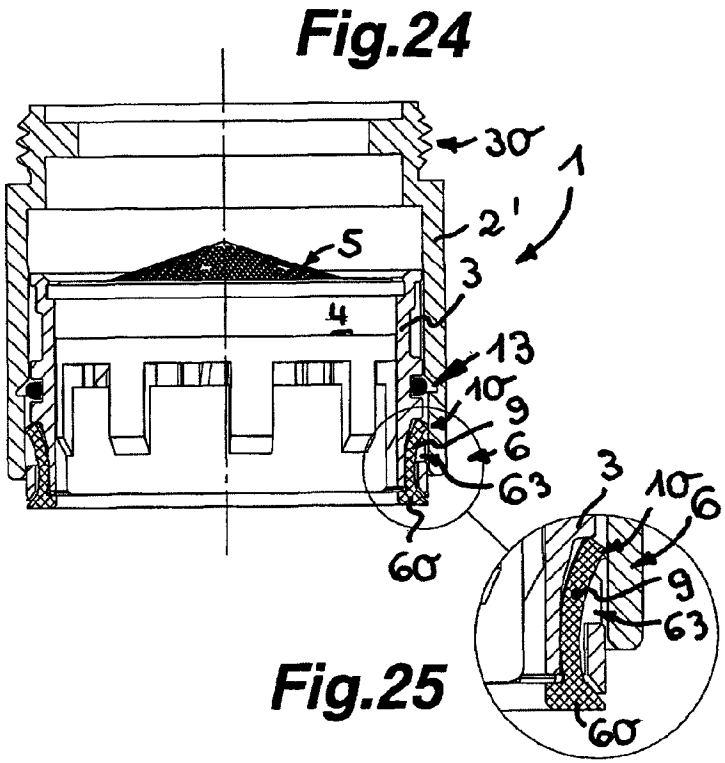
Fig.24
Fig.25
30
1
2'
3
13
10
9
6
63
60
5
4

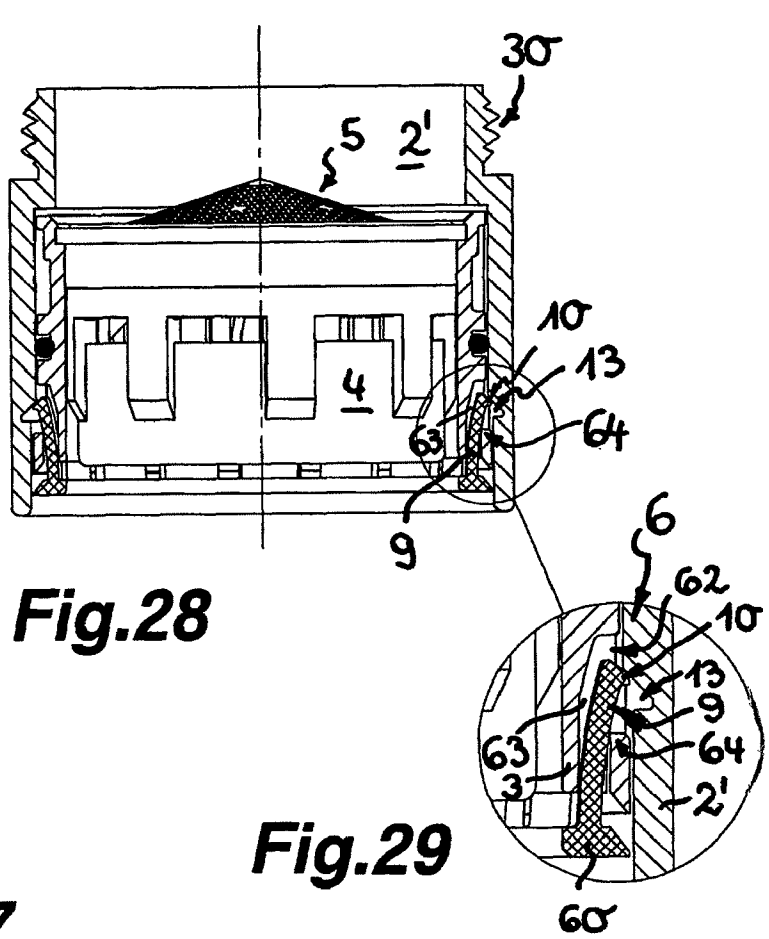
Fig.28
Fig.29
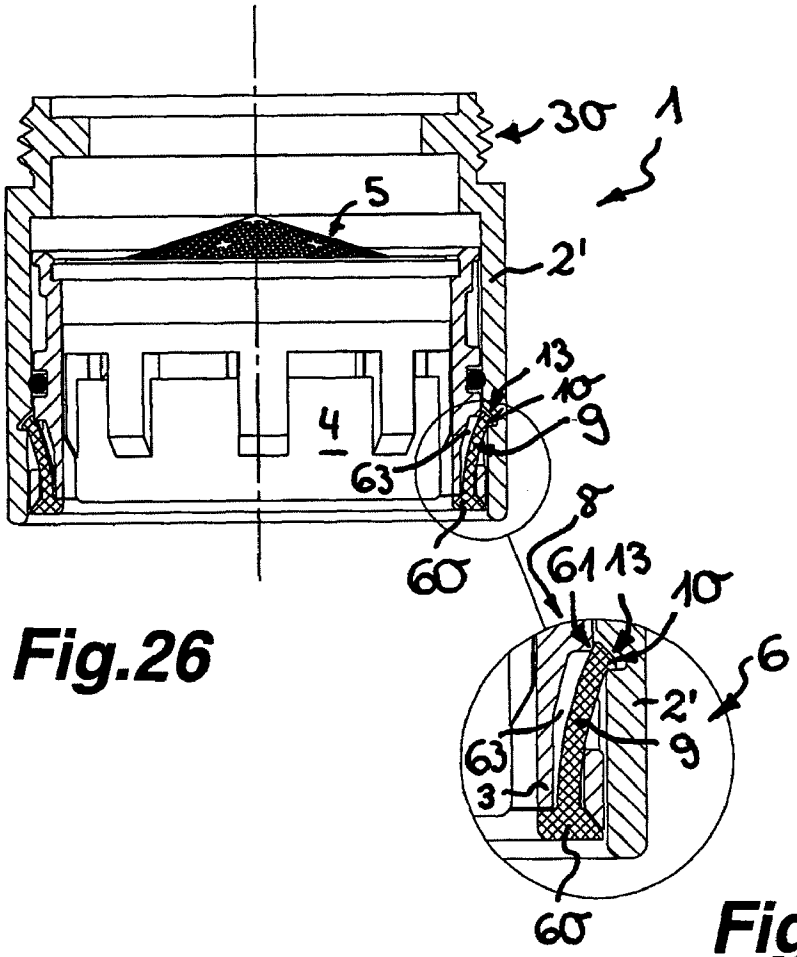
Fig.26
Fig.27

JET DIFFUSOR HAVING A WITHDRAWAL MECHANISM

BACKGROUND

The invention relates to a sanitary outlet fitting having a water outlet and having a jet regulator which is assigned to the water outlet and which has a jet regulator housing with insert parts situated therein, which jet regulator housing can be inserted by means of an axial push-in movement into the water outlet, and has a retainer with at least one radially movable projection for connecting to the water outlet.

Jet regulators in their entirety, or insert parts of such jet regulators, must be exchanged from time to time on account of wear, contamination and/or limescale formation and for hygienic reasons.

Jet regulators are conventionally situated in a housing which can be screwed into and out of an outlet fitting, with engagement points for a tool being formed on the jet regulator housing. The exchange of the jet regulator therefore requires a tool and that the operator have certain knowledge.

In devices in which a multiplicity of such jet regulators are installed, for example hotels, clinics and WC facilities, the overall servicing process is therefore relatively complex.

DE 38 17 270 A1 already describes a sanitary outlet fitting having a jet regulator which has a jet regulator housing which can be inserted by means of an axial push-in movement into a mouthpiece. Provided on the jet regulator housing, which holds various insert parts within it, is a retainer which serves to fix the jet regulator housing in the mouthpiece in the normal operating position and, in the event of an exceedance of a predefined back pressure, is released in such a way that the jet regulator either falls out of the jet regulator housing or else moves into a release position in which, for example, an annular duct which enlarges the overall passage cross section is formed around the jet regulator. For this purpose, the retainer of the known jet regulator has radially movable projections which are designed as spring clips and which, at their free ends, support latching ribs which engage into an encircling annular groove in the jet regulator housing. The previously known jet regulator can be used even in back-pressure-susceptible units, such as for example continuous-flow heaters, which otherwise tend toward damage and malfunctions in the event of an exceedance of a predefined back pressure. In contrast, simpler and faster assembly and disassembly is not an aim of the previously known jet regulator.

SUMMARY

It is therefore an object of the present invention to create a sanitary outlet fitting of the type mentioned in the introduction in which the jet regulator is securely held in the water outlet and which can be assembled and disassembled in a particularly simple and fast manner.

Said problem is solved according to the invention in particular in that, in the sanitary outlet fitting of the type specified in the introduction, either a locking element, which can be actuated from the outside without using tools, is provided for selectively securing and releasing the retainer, or in that an unlocking tool is provided which can be inserted by means of an axial push-in movement into annular space which is provided between the water outlet inner periphery and the housing outer periphery, with it being possible for said push-in movement of the unlocking tool to be converted into a radial movement of the at least one projection of the retainer from a functional position into an unlocking position.

The jet regulator which is used in the water outlet according to the invention can be assembled in a simple and comfortable manner using mere finger pressure. If said jet regulator is used for example in regions in which unauthorized manipulation of the water outlet and theft of the jet regulator are not of concern, it is possible for a locking element which can be actuated from the outside without tools to be provided for selectively securing and releasing the retainer. If, in contrast, the jet regulator is to be used, such that it is protected from manipulation and theft, for example also in public regions, it is possible instead for an unlocking tool to be provided which can be inserted by means of an axial push-in movement in the annular space which is provided between the water outlet inner periphery and the housing outer periphery, with it being possible for said push-in movement of the unlocking tool to be converted into a radial movement of the at least one projection of the retainer from a functional position into an unlocking position. Therefore, in said alternative too, substantially only an axial push-in movement by means of the unlocking tool is necessary in order to disassemble the jet regulator, which is used in the outlet fitting according to the invention, from the water outlet.

In the alternatives which are provided according to the invention, the exchange of the jet regulator may be carried out in a simple manner by auxiliary personnel who have knowledge only of simple handling. After the jet regulator is removed, the jet regulator in its entirety or its insert parts may be exchanged.

It is also advantageous that an exchange process of the jet regulator takes place considerably more quickly than before. This is particularly important where, for hygienic reasons, a frequent, possibly even daily exchange of the jet regulator is prescribed in order to carry out disinfection measures such as for example autoclave disinfection.

Particularly secure fixing of the jet regulator in the water outlet is obtained if the at least one radially movable projection is designed to engage into a depression which is situated in the water outlet.

The jet regulator which is designed according to the invention can be inserted into the water outlet of an outlet fitting which is specifically adapted to said jet regulator. If, in contrast, the jet regulator designed according to the invention is also intended to be used in connection with commercially available outlet fittings, it may be expedient if the water outlet is designed as an adapter mouthpiece, or mouthpiece, which can be preferably detachably connected to an outlet fitting.

If appropriate, the adapter mouthpiece may be provided with an inner recess as part of the latching retainer for holding the jet regulator housing, wherein the adapter mouthpiece can be connected to an outlet fitting.

It is expedient here if the adapter mouthpiece has a connecting thread for connecting to the outlet fitting.

The jet regulator which is provided according to the invention can thereby be used both directly in a correspondingly designed outlet fitting and also, by means of an adapter mouthpiece, on traditional fittings with a screw-in thread for a conventional screw-in jet regulator. For this purpose, the adapter mouthpiece is screwed once onto the outlet fitting. Simple retrofitting of existing fittings and a switch to the jet regulator which is provided according to the invention are therefore also possible.

The retainer is preferably a latching retainer with preferably a plurality of resilient latching projections.

In this way, when the jet regulator is inserted into the mouthpiece, said jet regulator is held in a predefined position by means of the locking element even before being secured.

The depression in the mouthpiece is expediently an annular groove which preferably runs around in water outlet.

The preparation of the fitting for holding the jet regulator is simplified since the annular groove can be formed significantly more simply than a true-to-gauge thread, and a large tolerance band is permissible in the annular groove. An encircling annular groove has the advantage that the jet regulator can be inserted in any desired rotational position.

The jet regulator housing expediently has, at the outside, a latching projection which can be deflected approximately radially and which, in the assembled position, engages into the annular groove, which forms an inner recess, of the mouthpiece, with the locking element being designed so as to be movable for blocking and enabling the deflection movement of the latching projection.

As the jet regulator is inserted axially into the mouthpiece, the latching projection is deflected radially inward by the wall of the mouthpiece until said latching projection engages, in the assembled position, into the inner recess of the mouthpiece or similar receiving part, and thereby fixes the jet regulator. To block the latching retainer and to secure the jet regulator, the locking element is then pushed in, such that the latching projection is blocked and the jet regulator is reliably prevented from being pushed out even during operation under the pressure loading of the liquid flow.

To remove the jet regulator, the locking element is pulled out slightly, and the jet regulator can then be removed.

According to one practical embodiment of the invention, the jet regulator housing has, at the outside, in particular distributed over the periphery, and as part of the latching retainer, spring elements with outwardly pointing latching projections at the free end regions. Here, the locking element is connected to the housing so as to be axially movable relative thereto, and in the securing position, supports the spring elements or the like approximately radially at the inside.

The spring elements which are arranged so as to be distributed over the periphery and which are for example also of lamellar design can deflect comparatively easily during the assembly of the jet regulator, such that the jet regulator housing can be pushed into the opening-out pipe of the outlet fitting with free movement. The locking element is then pushed in, such that the spring elements are then fixed and can thereby no longer be deflected.

A jet diffuser and one or more parts for jet formation are expediently provided as insert parts in the jet regulator housing. These are the wear parts which must be exchanged from time to time in particular on account of limescale formation and also for hygienic reasons.

The jet regulator is preferably inserted directly into the mouthpiece of the sanitary outlet fitting and connected to the latter by means of the latching retainer. As already mentioned above, it is however also possible for a connecting adapter with an inner recess, for example an annular groove, to be provided as part of the latching retainer for holding the jet regulator housing, and for the connecting adapter to be connected to the mouthpiece of the outlet fitting. In this case, it is possible to use a conventional outlet fitting for example with a connecting thread, with the connecting adapter then having a compatible connecting thread.

One embodiment provides that the jet regulator housing is part of the jet diffuser and in that the sleeve-shaped housing thereof has the spring elements with the latching projections. In this way, the number of parts of the jet regulator is reduced, and the design is thereby simplified. Among other things, no axial seal is required in this embodiment, since the jet diffuser housing is combined with the jet regulator housing, that is to say is formed from one piece.

As a result of the reduction of the number of parts, more installation space is available, such that the hook elements of the annular locking element can advantageously point outward and engage into slot-shaped recesses of the jet regulator housing.

It is advantageous if the locking element has a surface which is smooth and closed at the inside.

An accumulation of limescale on the inner side, which comes into contact with water, of the locking elements is counteracted in this way. Furthermore, the outwardly pointing hook elements are partitioned off by said wall of the locking element, such that an accumulation of limescale here is substantially prevented. A functional impairment of the locking element as a result of limescale, and therefore the capacity for dismounting, are thereby considerably improved.

The annular groove which is provided for the latching connection of the locking element and the jet regulator housing is expediently dimensioned to be of greater width than the width of the associated annular bead.

In this way, production-related fluctuations in the height of the chamfer and in the position of the annular groove in the mouthpiece can be compensated without impairing the security of the fastening.

According to another particularly simple embodiment of the invention, the jet regulator housing has spring elements with outwardly projecting latching projections for direct engagement into an annular groove or similar depression of the water outlet, with the latching projections simultaneously being the locking elements or having locking elements.

Here, two diametrically opposite spring elements with latching projections are expediently provided, which spring elements provide a sufficient retaining action of the jet regulator in a mouthpiece. Here, the jet regulator housing and the spring elements with the latching projections have, at the outflow side, a flange-like, outwardly pointing gripping projection.

Said jet regulator may likewise be assembled and disassembled without tools. For assembly, the jet regulator is pushed, for example with the palm of the hand, into the fitting mouthpiece. For disassembly, the two lateral, inwardly resiliently flexible latching elements are pressed together by means of two fingers on the gripping projections, and the jet regulator can then be pulled out.

According to one refinement of the invention, the latching elements have latching surfaces which run obliquely with an undercut with respect to the cross-sectional plane of the jet regulator.

In this way, a locking mechanism is formed which must be released before the jet regulator is removed. For this purpose, the jet regulator is firstly pushed axially inward slightly, and the locking action is thereby released. The latching elements are then deflected at the gripping projections, such that they pass out of engagement and the jet regulator can be removed.

Instead of the locking by means of the undercut latching surfaces on the latching elements, it is also possible for other locking elements to be provided for the detachable blocking of the latching projections against deflection.

According to a further design variant of the invention, the jet regulator housing may have a retainer with hooking elements, which can be released from an anchoring position and which are spring-loaded in the locking direction, for engaging on the inner wall of the mouthpiece, with a push-in and unlocking element being provided firstly for loading the jet regulator housing in the push-in direction and secondly for unlocking the hooking elements.

As a result of the hooking elements, no mating indentations are necessary in the mouthpiece into which said jet regulator is inserted. The mouthpiece may thus be a tube which is not machined in this respect.

In any case, it may be expedient for the purpose of particularly good anchoring if the inner wall of the mouthpiece has a rough surface.

It is expedient if the wall of the push-in and unlocking element is of approximately Z-shaped design with a shoulder in cross section, and if passage windows for the hooking elements, which are situated on the annular jet regulator housing, are provided in the region of said shoulder.

During assembly, the jet regulator is pushed into a mouthpiece by being simply pressed in by hand, with the insertion force being transmitted via the annular push-in and unlocking elements to the likewise annular jet regulator housing with the jet diffuser situated therein. The shoulder which is situated on the push-in and unlocking element and which is formed by the Z-shape bears here against the end side of the jet regulator housing which has the hooking elements.

The jet regulator is then held in the final assembly position by means of the outwardly spring-loaded hooking elements which are supported on the mouthpiece inner wall.

For disassembly, the push-in and unlocking element has, at its outflow-side end, a flange-like, outwardly pointing gripping projection which projects beyond the lower end of the mouthpiece. For disassembly, said gripping projection is pulled, with push-in and unlocking element, which is cranked in a Z-shape, abutting with the upper edges of the passage windows against the obliquely-aligned hooking elements, and adjusting said hooking elements slightly inwardly or at least reducing their pressure force, such that it is possible for the jet regulator to be removed from the mouthpiece.

One preferred refinement according to the invention, which is worthy of protection in itself, provides that the retainer has spring elements which are guided in housing pockets, which are open at both sides, of the jet regulator housing, which spring elements have, at their free spring element ends, in each case one latching projection which, in the functional position of the jet regulator, projects radially over a housing pocket opening. In this refining embodiment, the retainer has axially movably guided spring elements. Said spring elements are guided in housing pockets, which are open at both sides, of the jet regulator housing, and have, at their free spring element ends, in each case one latching projection which, in the functional position of the jet regulator, projects radially over a housing pocket opening, in such a way that the jet regulator housing is securely and fixedly held in the water outlet.

Here, it is particularly advantageous if the opening edge of the housing pocket opening is designed as a locking element which, in the functional position of the jet regulator, loads the free partial region, which has the latching projection, of at least one spring element in such a way that the projection, which projects radially over the housing pocket opening, of the at least one spring element is secured in the depression of the water outlet. In this embodiment, in the functional position of the jet regulator, the free spring element end which has the latching projections is acted on and supported by the opening edge of the housing pocket opening in such a way that said spring element end cannot, in particular in the case of increasing flow-induced pressure, for example, deflect out of the depression of the water outlet.

In order to release the jet regulator housing from the water outlet and to be able to dismount the jet regulator, it is advantageous if, by means of a relative movement of the jet regulator housing and retainer, the spring elements which are guided in housing pockets can be moved in such a way that the latching projections which are provided on the spring elements can be moved into an unlocking position in which said latching projections are retracted radially inward into the housing pockets. As a result of a simple relative movement of the jet regulator housing and the retainer, for example by moving the jet regulator housing into the water outlet while the retainer simultaneously lags behind, the pressure which is exerted by the opening edge of the housing pocket opening on the free spring clip ends is removed, such that the spring clips can retract into the housing pockets and move into their unlocking position. Once the spring clips are in their unlocking position, the jet regulator housing can be pressed out of the water outlet for example by the pressure of the water flowing to the water outlet.

In order to be able to move the spring elements which are situated in the housing pockets simultaneously, it is advantageous if the retainer has an annular gripping projection from which the spring elements project in the shape of a crown.

One preferred and structurally particularly simple embodiment according to the invention provides that each housing pocket has two housing pocket openings, of which a first housing pocket opening is provided at the outflow-side end edge of the jet regulator housing and a second housing pocket opening is provided at the housing outer periphery.

In an alternative, in which an unlocking tool is provided, it is advantageous if the spring elements which are provided at the outside on the jet regulator housing are aligned with their free end regions in the direction of the inflow side of the jet regulator. If the free end regions of the spring elements are aligned in the direction of the inflow side of the jet regulator, it is easier for a force to be exerted on said free end regions from the outflow side of the water outlet, and for said free end regions to be moved radially inward into their unlocking position.

In order that no residual latching resistance between the jet regulator housing and the water outlet must be overcome in the unlocking position of the spring elements, it is advantageous if the spring elements can, by means of the unlocking tool, be retracted within the circular envelope defined by the greatest housing diameter.

The jet regulator housing can also be removed from the water outlet with the aid of the unlocking tool if the jet regulator housing and the unlocking tool can be detachably coupled to one another. Here, one preferred embodiment of the invention provides that the jet regulator housing and the unlocking tool can be detachably latched to one another and that, of the jet regulator housing and unlocking tool, one part has at least one latching projection and the other part has at least one latching recess.

In order to be able to release the connection provided between the jet regulator housing and the unlocking tool and to separate the jet regulator housing from the unlocking tool in a simple manner, it is advantageous if the inflow-side partial region of the jet regulator housing, in its coupled or latched position with the unlocking tool, projects over the unlocking tool. The jet regulator housing can thereby be gripped at its partial region which projects over the unlocking tool, and the connection which is provided between the jet regulator housing and the unlocking tool can be overcome by hand.

BRIEF DESCRIPTION OF THE DRAWINGS

Additional embodiments of the invention are described in the further subclaims. Exemplary embodiments of the invention are described in more detail below on the basis of the drawings, in which:

FIG. 6 and FIG. 7 are longitudinal section illustrations of an embodiment variant of a jet regulator according to the invention, in different section planes, FIG. 12 and FIG. 13 are longitudinal section illustrations of the jet regulator shown in FIGS. 10 and 11, in different section planes, FIG. 13*a* shows a detailed view of the jet regulator as per FIG. 13 in the region of a positioning cam, FIG. 14 shows an underside view of a jet regulator in a further embodiment, FIG. 15 shows a dimetric view of the jet regulator shown in FIG. 14, FIG. 16 and FIG. 17 are longitudinal section illustrations of the jet regulator shown in FIGS. 14 and 15, in different section planes, FIG. 18 shows an underside view of a jet regulator as per FIGS. 1 to 7, FIG. 19 shows a dimetric view of a further embodiment of a jet regulator, with hooking elements which are situated on the housing, and with a push-in and locking element, FIG. 22 shows a jet regulator longitudinally in section in the region of its jet regulator housing, which jet regulator can be inserted by means of an axial push-in movement into the water outlet, with the jet regulator housing having a retainer with a plurality of radially movable projections for connecting to the water outlet, FIG. 23 shows the jet regulator from FIG. 22 in a detailed longitudinal section in the region of the retainer which is provided between the jet regulator housing and the water outlet, FIG. 24 shows the jet regulator from FIGS. 22 and 23 during the push-in movement into the water outlet, FIG. 25 shows the jet regulator according to FIGS. 22 to 24 in a detailed longitudinal section from FIG. 24 in the region of the retainer, FIG. 26 shows the jet regulator from FIGS. 22 to 25 situated in its functional position in a water outlet, FIG. 27 shows the jet regulator as per FIGS. 22 to 26 in a detailed longitudinal section from FIG. 26 in the region of the retainer, FIG. 28 shows the jet regulator illustrated in FIGS. 22 to 27 directly before being dismounted from the water outlet, with the retainer which is provided between the jet regulator housing and the water outlet already being in its unlocking position, FIG. 29 shows the jet regulator as per FIGS. 22 to 28 in a detailed longitudinal section from FIG. 28 in the region of the retainer.

DETAILED DESCRIPTION OF PREFERRED EMBODIMENTS

Figure 1:
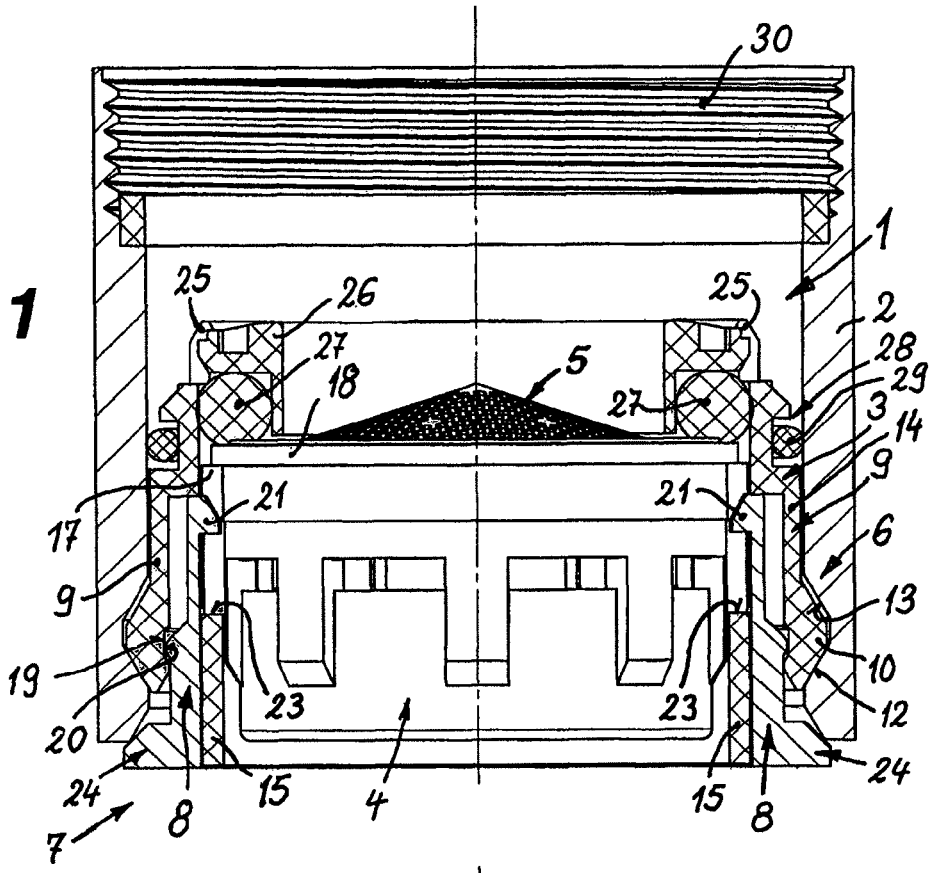
FIG. 1 and FIG. 2 are longitudinal section illustrations of a jet regulator which is inserted into an adapter mouthpiece, in different section planes.
Figure 2:
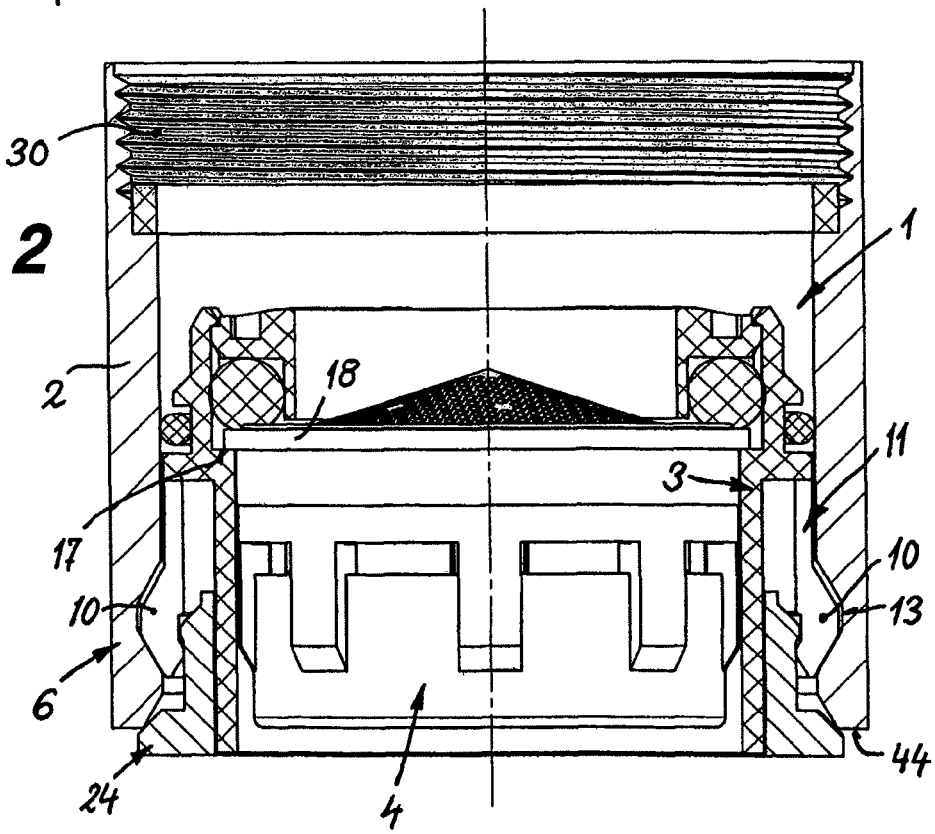

A jet regulator 1 shown in FIGS. 1 to 4 is inserted, as per FIGS. 1 and 2, into a tubular adapter mouthpiece 2 which can in turn be connected by means of its connecting thread 30 to a sanitary outlet fitting (not illustrated in any more detail).

The jet regulator 1 has a housing 3 with insert parts situated therein. In the exemplary embodiment shown, a jet diffuser 4 and an ancillary filter 5 are shown as insert parts.

The connection between the jet regulator 1 and the mouthpiece 2 takes place by means of a latching retainer 6. In this way, the jet regulator can be pushed into and latched in the mouthpiece 2 from the outlet side 7 of the latter. The latching connection is secured by means of a locking element 8, such that, firstly, the jet regulator can be inserted and removed with free movement, and secondly, secure hold is however provided in the functional position, such that even high flow pressures can be absorbed.

Figure 5:
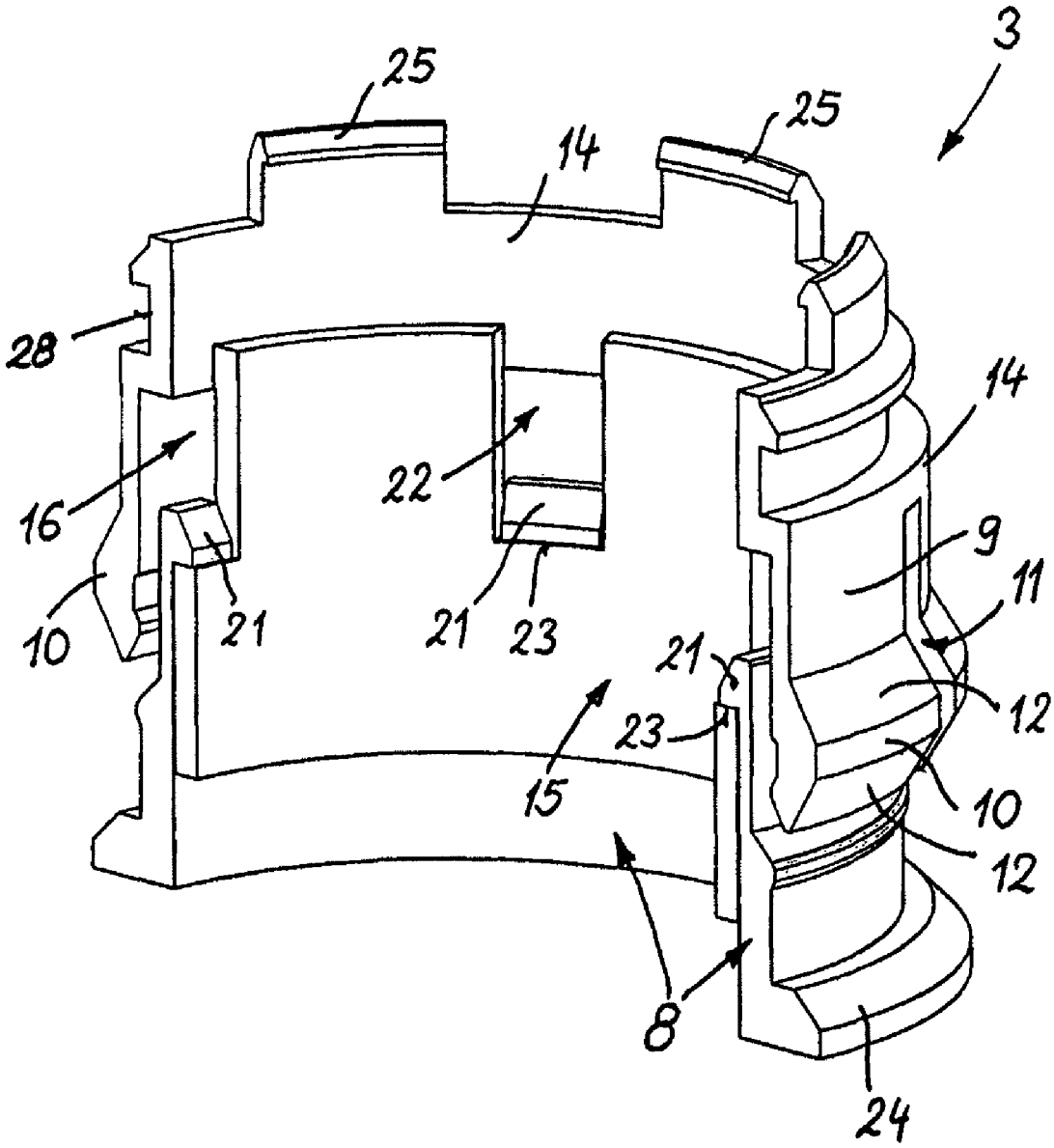
FIG. 5 shows a dimetric view of a half-illustrated jet regulator housing with a locking element.

The jet regulator housing 3 is shown in a half-illustration in a perspective view in FIG. 5 in the unlocked position, and it is possible to clearly see that the housing has, distributed over the periphery, lamellar spring elements 9 with outwardly-pointing latching projections 10 situated at the free end regions which point in the flow direction. Here, the spring elements 9 are part of the outer wall 14 of the housing 3. FIG. 5 clearly shows that the adjacent spring elements 9 are separated from one another by axial slots 11, such that said spring elements 9 can be deflected with free movement.

The latching projections 10 have, at both sides in the axial direction, run-on chamfers 12 in order to facilitate the insertion of the jet regulator into the mouthpiece 2 and also the removal of the jet regulator when the locking element 8 is unlocked. In the functional position of the jet regulator 1, the latching projections 10 engage into an inner annular groove 13 of the mouthpiece 2. The cross-sectional shape of said annular groove 13 corresponds approximately to the cross section of the latching projections 10. As the jet regulator 1 is inserted and removed, the latching projections 10 which are situated on the spring elements 9 are deflected radially inward slightly according to the arrow Pf 1 in FIGS. 3 and 4, and as the jet regulator 1 is inserted into the functional position, said latching positions 10 spring back into the annular groove 13.

The annular locking element 8 is movable in the axial direction and is connected to the housing 3 of the latching retainer 6. The locking element 8 is in the blocking position in FIGS. 1 and 2, and in a partially pulled-out release position in FIGS. 3, 4 and 5.

As can be clearly seen in FIGS. 1 to 5, the jet regulator housing 3 is of double-walled design in regions and has, arranged coaxially with respect to and spaced apart inwardly from the outer wall 14, an annular sleeve 15. An annular gap 16 for the axially movable, annular locking element 8 is formed between said annular sleeve and the outer wall 14. The locking element 8 is thereby guided in the axial direction and, in the locking position, can also be supported at the rear side on the annular sleeve 15.

The annular sleeve 15 also forms a receptacle for the jet diffuser 4 and has, at the inflow-side end, a rest shoulder 17 on which the jet diffuser 4 rests with an annular flange 18.

Figure 3:
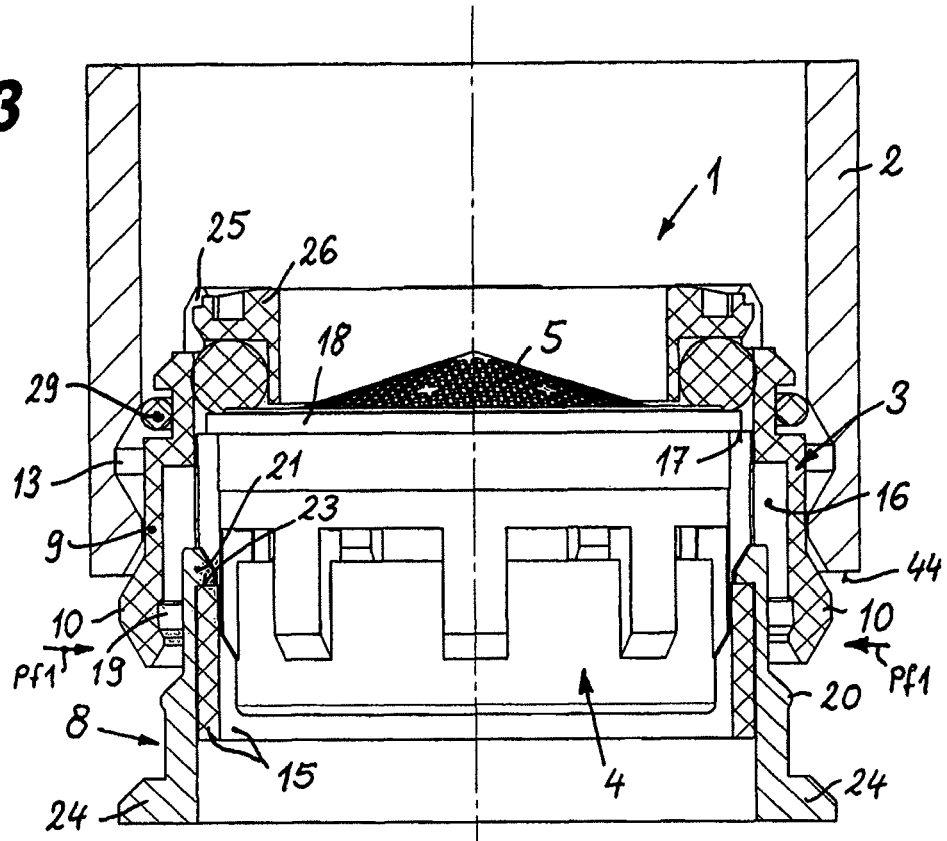
FIG. 3 and FIG. 4 are longitudinal section illustrations of the jet regulator in a position having been pulled partially out of a mouthpiece, in different section planes.
Figure 4:
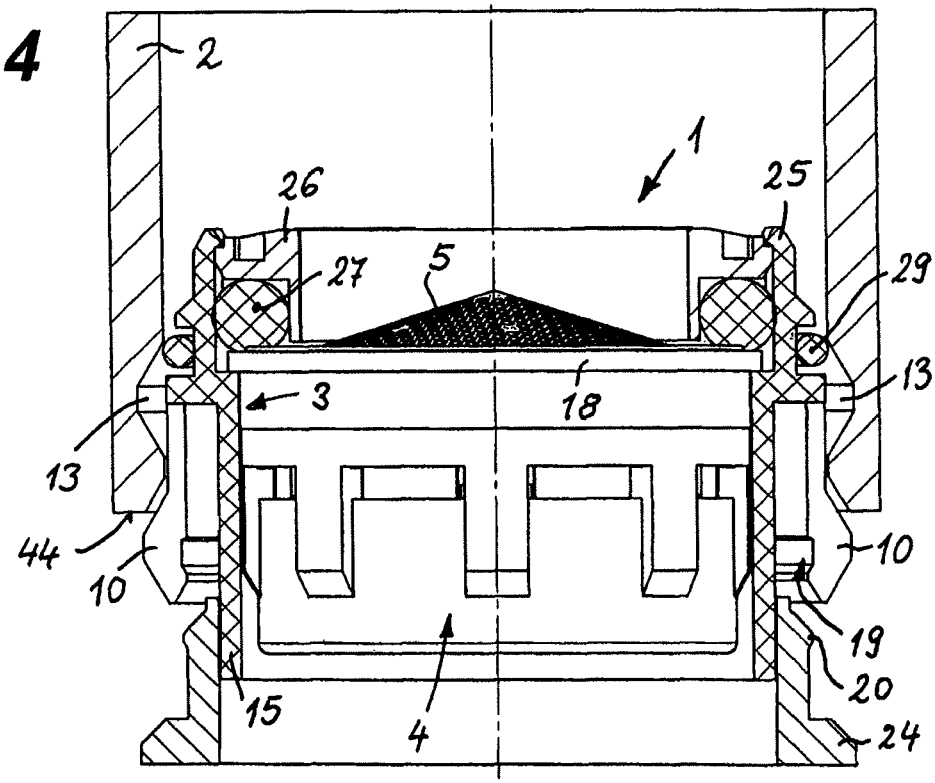

The locking element 8 can be moved between the locking position shown in FIGS. 1 and 2 and the release position shown in FIGS. 3 to 5.

The locking element has an outer, encircling annular bead 20 which, in the locking position, latches into an annular groove 19 which is provided at the inside on the spring elements 9 or on the latching projections. In the unlocking position, the two locking formations 19, 20 have oblique surfaces, such that the locking element 8 can be moved into the release position with comparatively free movement.

The annular groove 19 is dimensioned in the axial direction to be of greater width than the width of the associated annular bead 20 in order that the locking element 8 can compensate position differences of the groove 13.

The unlocking movement of the locking element 8 is limited by hook elements 21. The hook elements 21 engage into recesses 22 of the annular sleeve 15 and, in the release position, bear against the outflow-side delimiting surfaces 23 of said recesses 22. The housing 3 and the locking element 8 are thereby captively connected to one another. Furthermore, in the release position, the locking element 8 forms a good manual holding facility in order to be able to pull the jet regulator 1 out of the mouthpiece.

The hook elements 21 therefore form, in connection with the outflow-side delimiting surfaces 23 of the recesses 22, a movement stop in the pull-out direction, and in the push-in direction, a stop is provided between the face ends of the hook elements and the transition between the outer wall 14 and the annular sleeve 15. Furthermore, the locking element 8 bears with a gripping projection 24 against the outer edge of the mouthpiece.

The gripping projection 24 which is provided at the outflow-side end of the locking element 8 and which is designed so as to point approximately radially outward and, in the locking position (FIGS. 1 and 2), projects over the lower edge 44 of the mouthpiece 2, makes it easier for the locking element 8 to be manually gripped and pulled out during the unlocking process.

The jet regulator housing 3 has, at the inflow side, inwardly pointing latching projections 25 for a retaining ring 26. Said retaining ring 26 serves to fix the insert parts, that is to say the jet diffuser 4 and the ancillary sieve 5 which adjoins said jet diffuser 4 at the inflow side. Here, the retaining ring 26 acts on an O-ring 27 which in turn rests on the upper edge of the jet diffuser 4. Furthermore, the jet regulator housing 3 has, at the outside, an annular groove 28 for a sealing ring 29, which sealing ring 29 provides a sealing action between the inner wall of the mouthpiece 2 or the like and the housing 3.

FIGS. 6 to 9 show another embodiment of a jet regulator 1*a* in which the jet regulator housing 3*a* is part of the jet diffuser 4. Here, the sleeve-shaped housing of said jet regulator housing 3*a* has the spring elements 9 with the latching projections 10. The locking element 8*a* is of annular design and has, in this exemplary embodiment, outwardly pointing hook elements 21 which engaged into slot-shaped recesses 22*a* of the jet regulator 3*a* which is simultaneously the housing of the jet diffuser 4.

It is possible to clearly see in particular in FIGS. 6 and 7 that the annular locking element 8*a* has a surface which is smooth and closed at the inside. As a result of the outwardly pointing hook elements 21, said surface is situated outside the water flow and is thereby well protected against limescale formation. Even in the event of the jet regulator being relatively heavily loaded with limescale overall, said functional elements remain free, such that even in a heavily limescale-loaded state, the jet regulator can still be dismounted.

As a result of the combination of the jet diffuser housing and jet regulator housing 3*a*, the number of parts is reduced. Furthermore, on account of said single-piece design, no additional axial seal is necessary as is the case with a two-part design.

In said embodiment, too, a latching connection is provided between the locking element 8*a* and the jet regulator housing 3*a*. Here, an annular bead 20 is provided at the outside on the locking element 8*a* and an annular groove 19 is provided at the inside on the hook element 10. In this exemplary embodiment, it is possible to clearly see that the annular groove 19 is of slightly wider design, such that production-related fluctuations in the height of the chamfer and in the position of the annular groove 13 in the mouthpiece 2 can be compensated without the security of the fastening being impaired.

Figure 8:
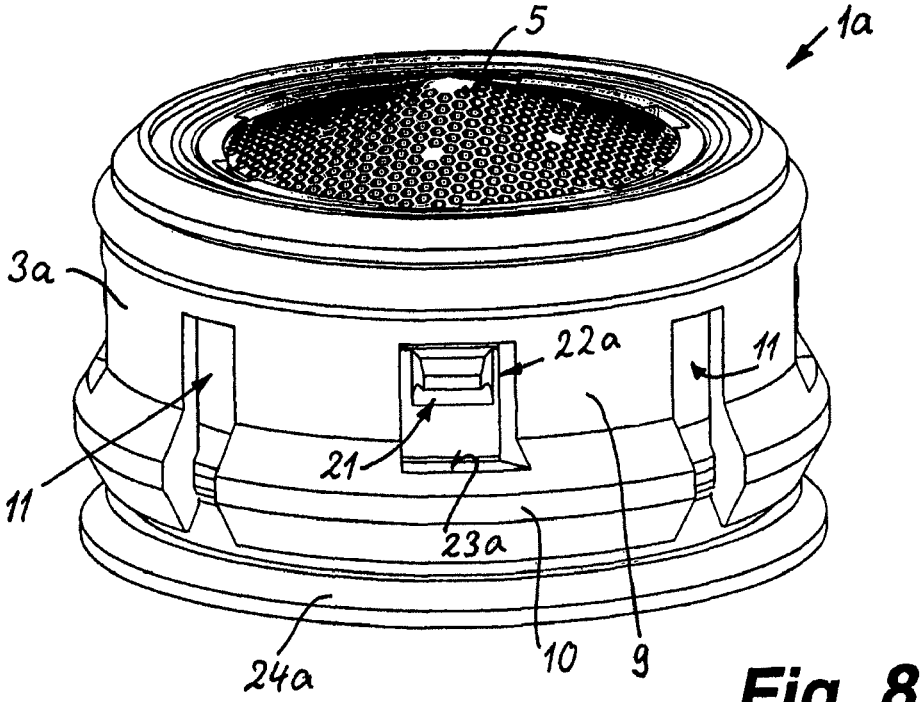
FIG. 8 shows a dimetric view of a jet regulator as per FIGS. 6 and 7, but without a mouthpiece here.
Figure 9:
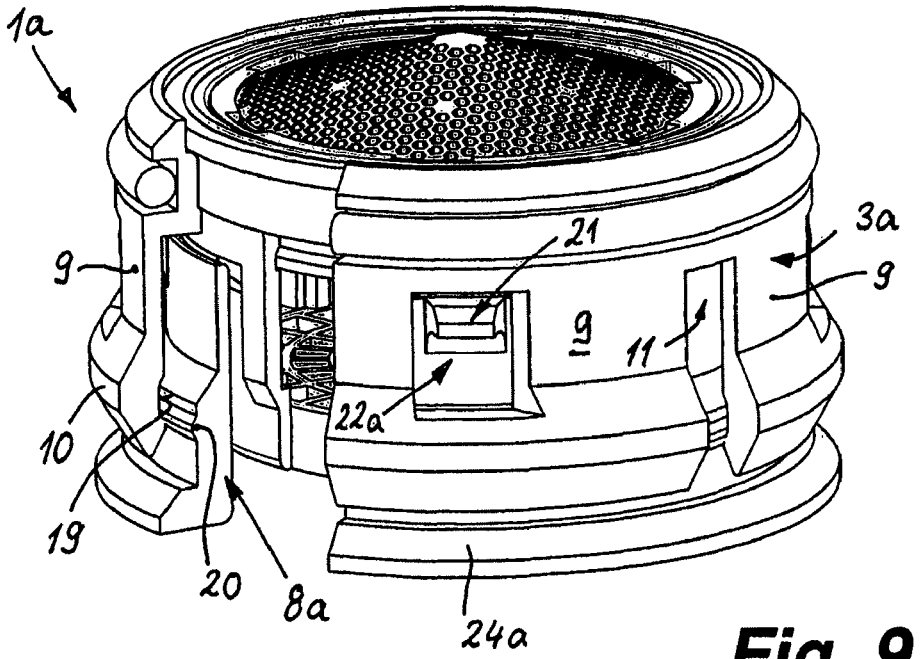
FIG. 9 shows a dimetric view of the jet regulator in FIG. 8, with a stepped section.
Figure 10:
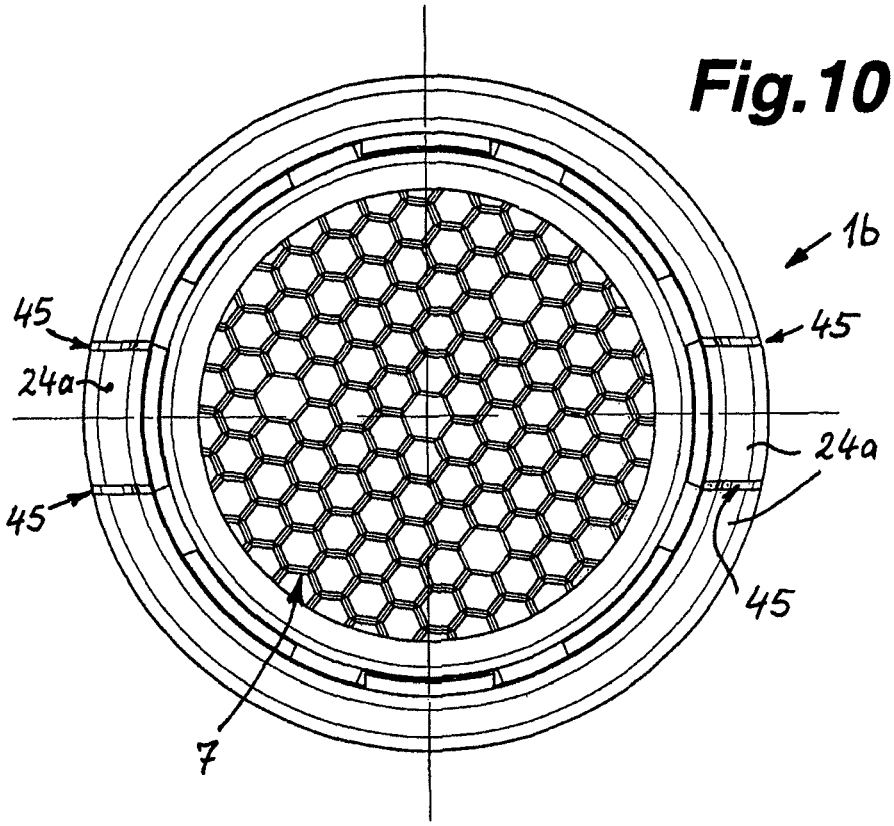
FIG. 10 shows an underside of a jet regulator.

In FIGS. 8 and 9, too, it is possible to see that the jet regulator housing 3*a* has, distributed over the periphery, axial slots 11 in order to facilitate free movement of the spring elements 9.

FIGS. 10 to 17 show a further embodiment of a jet regulator 1*b* according to the invention, the jet regulator housing 3*b*, 3*c* of which jet regulator 1*b* has spring elements 9*a* with outwardly projecting latching projections 10*a* for direct engagement into an annular groove 13*a* of the mouthpiece 2*a*. In this case, the latching projections 10*a* simultaneously form the locking elements, such that a locking element which is designed as a separate part is not required here.

In the exemplary embodiment, two diametrically opposite spring elements 9*a* with latching projections 10*a* are provided. Said spring elements 9*a* with the latching projections 10*a* are integrally connected, with their side facing away from the outflow side 7 of the jet regulator, to the jet regulator housing wall, and are separated from the adjoining housing wall by lateral slots. At the outflow side, the jet regulator housing 3*b* is adjoined by a flange-like, outwardly pointing gripping projection 24*a*. In the region of the spring elements 9*a* with the latching projections 10*a*, the gripping projection 24*a* is split up by the lateral slots 45, such that that part of the gripping projection 24*a* which is connected to the spring element 9*a* can be pressed inward with finger pressure in order to radially deflect the latching projections 10*a*. The remaining region of the gripping projection 24*a* which is connected to the housing 3*b* also serves for pulling the jet regulator 1*b* out of a mouthpiece 2*a* (cf. FIGS. 12 and 13).

Figure 11:
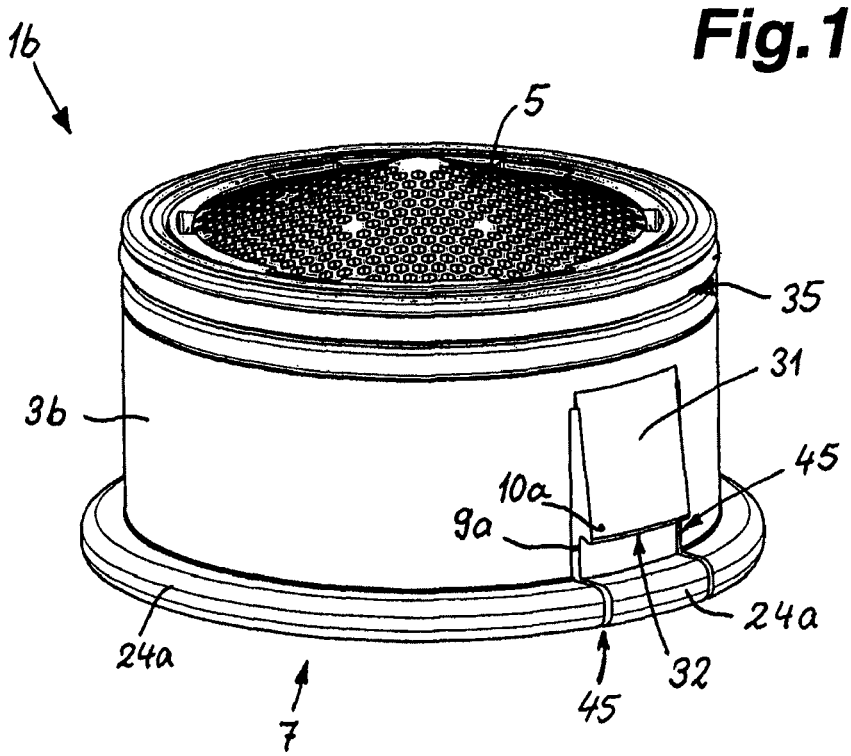
FIG. 11 shows a dimetric view of a jet regulator with a spring element and latching projection situated on the housing.

It can be clearly seen in particular in FIG. 11 that the latching projections 10*a* have run-on chamfers 31 which merge into the housing outer side. As the jet regulator 1*b* is inserted into a mouthpiece, said run-on chamfers 31 impinge on the inner edge of the mouthpiece and, as the jet regulator 1*b* is inserted further into said mouthpiece, are deflected radially inward until the latching projections 10*a* latch radially outward into the encircling annular groove 13*a*. The latching projections 10*a* are arranged with their latching surfaces 32 spaced apart from the outflow-side edge 33 of the housing 3*b* and from the gripping projection 24*a*, such that the housing 3*b* protrudes downward with its gripping projection 24*a* to such an extent that it can be gripped in order to be unlocked and pulled out.

The function of a locking element is assumed in the present exemplary embodiment by the latching surfaces 32 which are provided with an undercut and which engage into correspondingly oppositely formed formations of the annular groove 13*a*. The undercut is designed such that, to unlock the jet regulator 1*b*, the latter must firstly be raised slightly and thereby pushed into the mouthpiece slightly until the undercut is free, such that the latching projections 10*a* can then be unlocked by radially pressing in that section of the gripping projection 24*a* which is connected thereto. The jet regulator 1*b* can then be removed from the mouthpiece in the downward direction.

The detailed view in FIG. 13*a* shows an inwardly projecting positioning cam 36 for a jet diffuser 4 which is to be inserted. In this way, the jet diffuser 4 can be inserted into the housing 3*b* so as to be correctly positioned.

In FIGS. 10 to 13, the sealing of the jet regulator 1*b* with respect to the mouthpiece 2*a* takes place by means of a radial seal with an O-ring groove flange 35 which is situated on the jet diffuser 4. The O-ring groove flange 35 with the sealing element situated therein is situated at the inflow side on an annular end side 34 of the jet regulator housing 3*b*. It is expedient here if the end side 34 is connected, preferably by means of ultrasound welding, to the jet diffuser 4.

FIGS. 14 to 17 show a further embodiment variant in which the jet regulator housing 3*c* has, at the outside at its inflow-side end, an annular groove 46 with an annular seal 47 situated therein for radial sealing with respect to a mouthpiece 2*a*. The housing 3*c* is formed in a continuous fashion as a sleeve with a surface which is smooth and closed at the inside. The jet diffuser 4 is inserted into said sleeve-shaped jet regulator housing 3*c*. The connection and sealing between the jet regulator housing 3*c* and the inserted jet diffuser 4 may take place by means of a joining process, for example by means of ultrasound welding. This takes place in the region of a rest shoulder 48 and the inflow-side end side of the jet regulator housing 3*c*. In this embodiment, too, the latching and locking elements are partitioned off with respect to the water flow, such that a susceptibility to limescale formation is significantly reduced.

Figure 16:
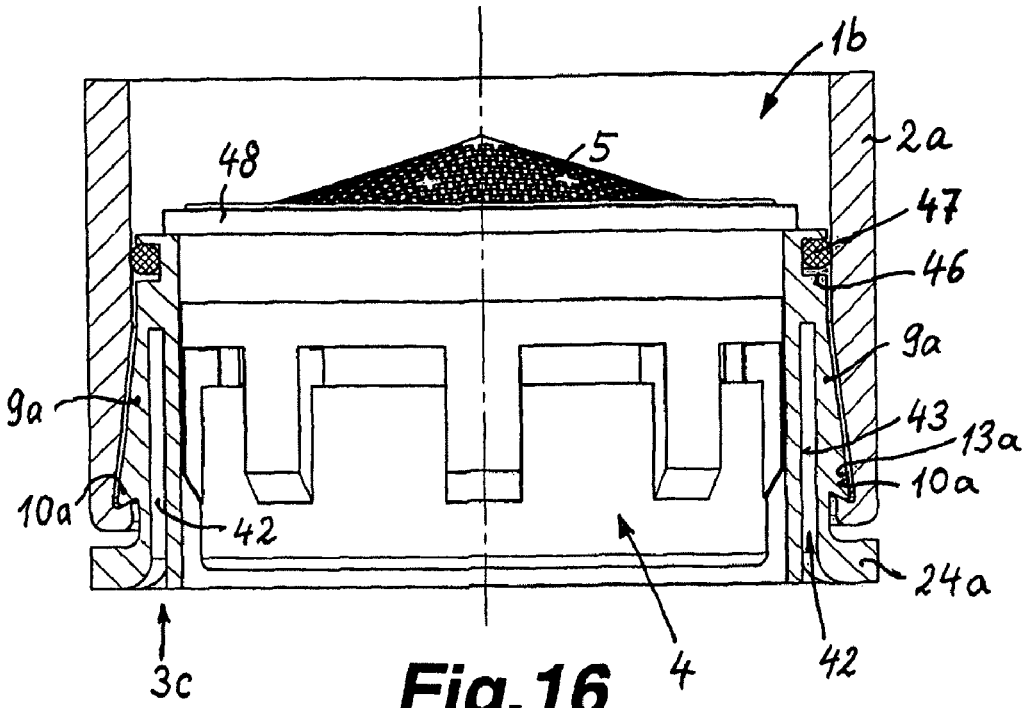
Figure 17:
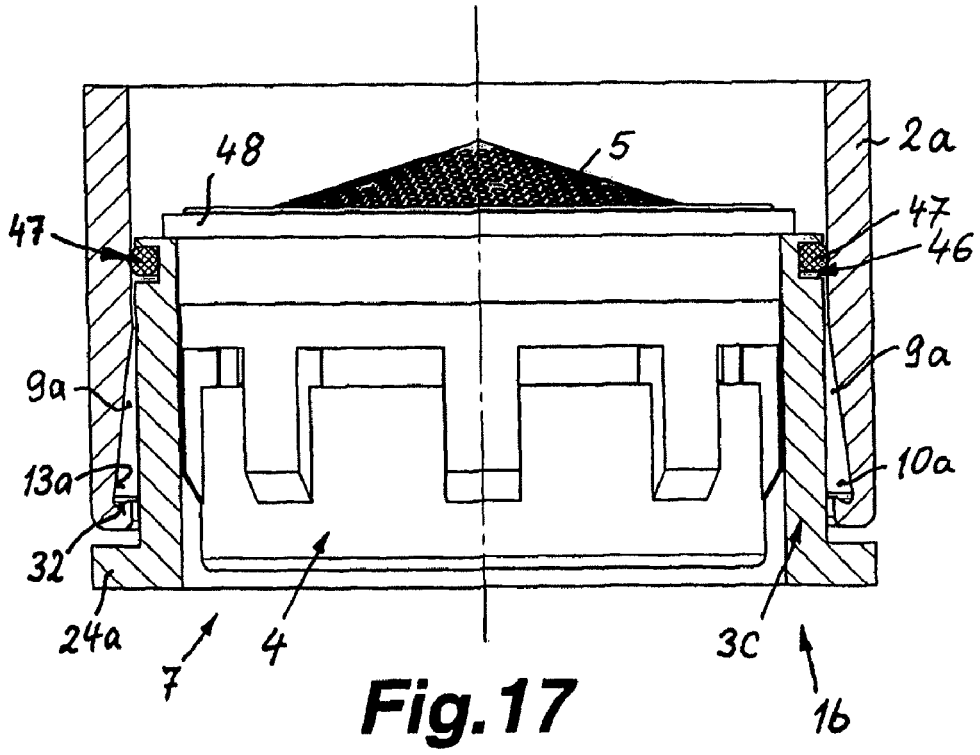

In FIG. 16, it can be clearly seen that the wall of the jet regulator housing 3*c* has, in the region of the spring elements 9*a*, an inwardly closed recess 42 with an outer side 43 which is spaced apart from the spring element 9*a* at least by the deflection travel of the spring element. In this way, firstly, sufficient deflection space is provided for the spring elements 9*a* with their latching projections 10*a*, and secondly, an inwardly closed wall is also provided in said region.

FIG. 18 shows an underside view, which corresponds to the design variants as per FIG. 1 to FIG. 7 and FIGS. 19 to 21, of a jet regulator 1, 1*a*, 1*c*.

Figure 20:
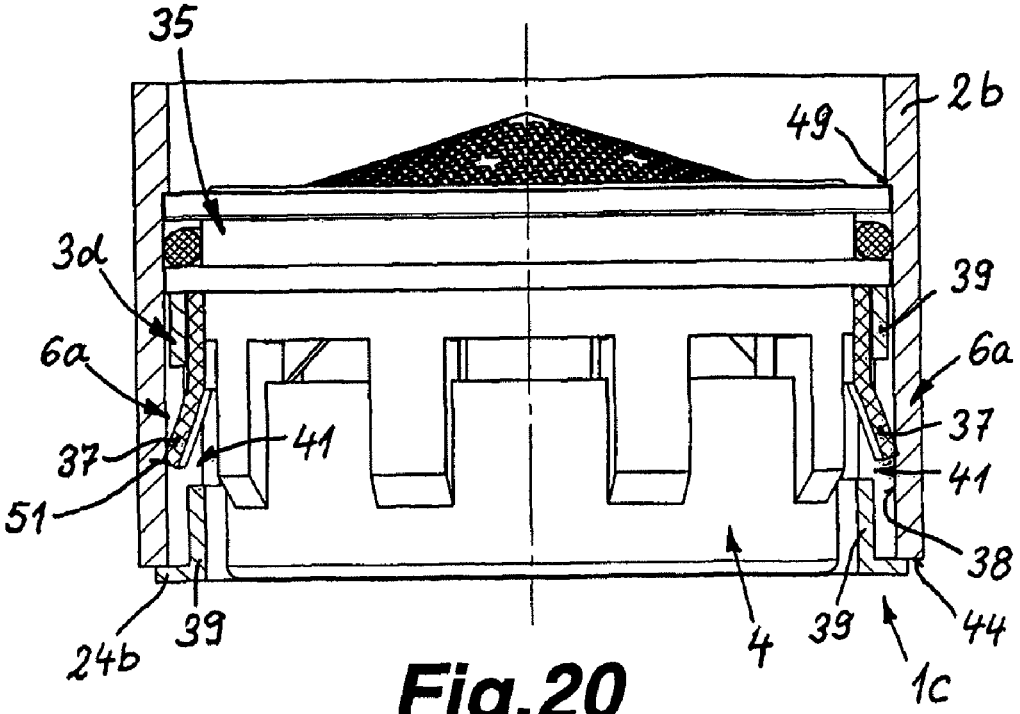
FIG. 20 and FIG. 21 are longitudinal section illustrations of the jet regulator shown in FIG. 19, in different section planes.
Figure 21:
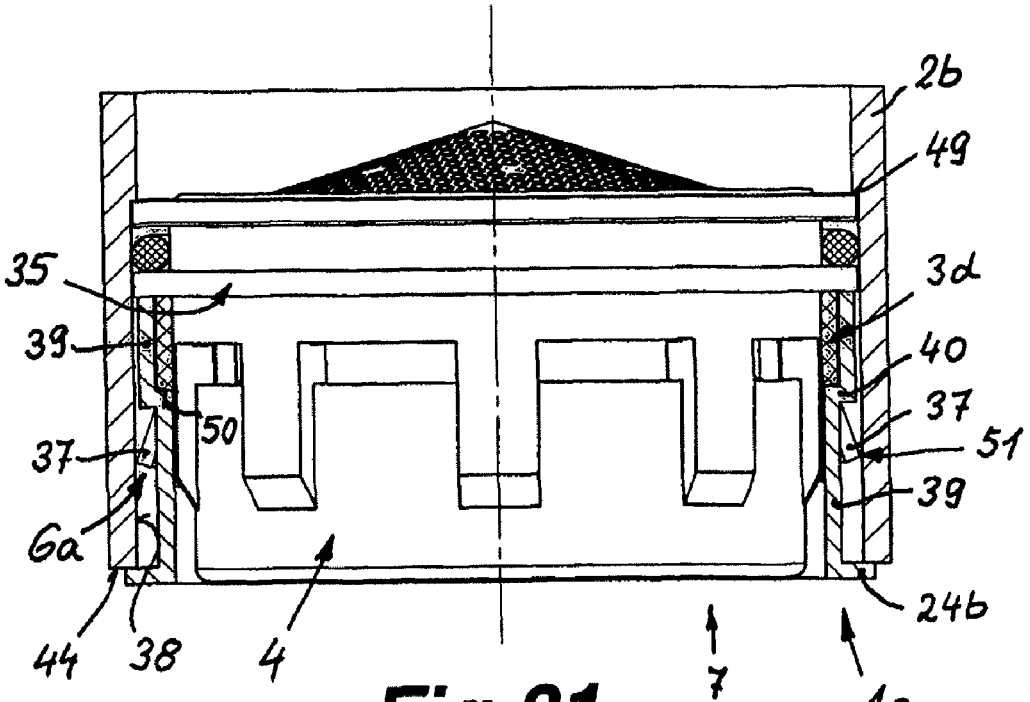
Figure 32:
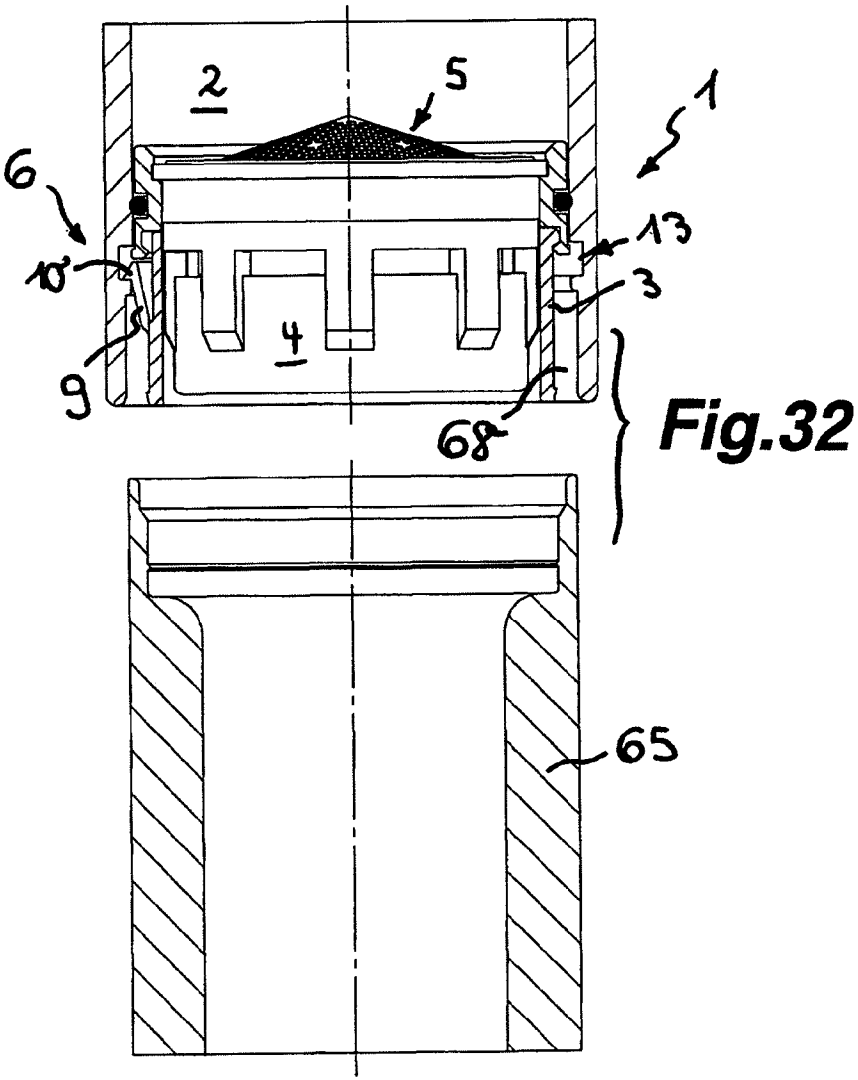
FIG. 32 shows the jet regulator from FIGS. 30 and 31 in the water outlet of a water outlet fitting, together with the unlocking tool assigned to it.
Figure 30:
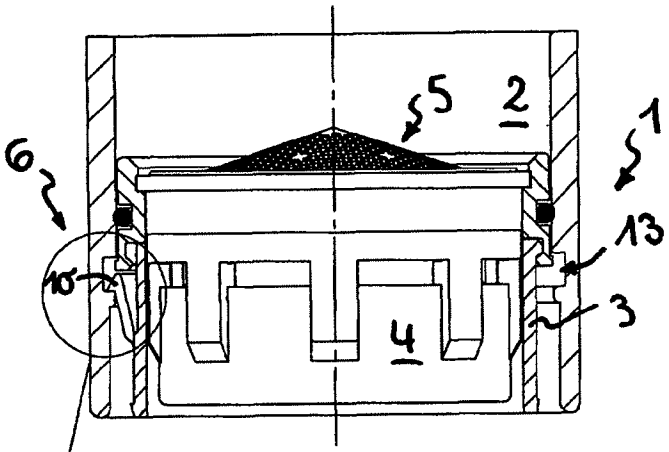
FIG. 30 shows a jet regulator longitudinally in section in the region of its jet regulator housing, which jet regulator can be inserted by means of an axial push-in movement into a water outlet of a sanitary outlet fitting, with an unlocking tool being required for dismounting this jet regulator from the water outlet.
Figure 31:
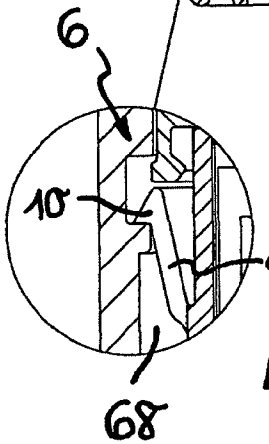
FIG. 31 shows the jet regulator from FIG. 30 in a detailed longitudinal section from FIG. 30 in the region of the retainer.

A further design variant of a jet regulator 1*c* according to the invention is shown in FIGS. 19 to 21. Said jet regulator 1*c* has an annular jet regulator housing 3*d* with a retainer 6*a* which has hooking elements 37, which can be released from an anchoring position and which deflect in a locking direction, for engaging on the inner wall 38 of the mouthpiece 2*b*.

Furthermore, a push-in and unlocking element 39 is provided firstly for loading the jet regulator housing 3*d* in the push-in direction and secondly for unlocking the hooking elements 37. It can be seen in FIGS. 19 and 21 that the wall of the push-in and unlocking element 39 is of approximately Z-shaped design with a shoulder 40 in cross section. Passage windows 41 for the hooking elements 37 are provided, distributed over the periphery of the push-in and unlocking element 39, in the region of said shoulder 40, with said hooking elements 37 extending through the passage windows 41 from the inside to the outside in the release position.

The lug-shaped hooking elements 37 project obliquely outward over the outflow-side edge 50 of the annular housing 3*d*. As the jet regulator 1*c* is inserted into a mouthpiece 2*b*, the hooking elements 27 are deflected radially slightly and fix the jet regulator 1*c* within the mouthpiece by interlocking so as to prevent said jet regulator 1*c* from being pulled out. Here, the outer edges 51 of the hooking elements 37 are supported on the inner wall 38 of the mouthpiece 2*b*. In this exemplary embodiment, no annular groove or the like is necessary within the mouthpiece 2*b*. The conventional roughness of the inner wall is sufficient to permit secure retention of the jet regulator. In the exemplary embodiment shown, the mouthpiece 2*b* which holds the jet regulator 1*c* has an inner insert stop 49 for the jet regulator 1*c*.

Here, the hooking elements 37 simultaneously form latching elements and locking elements. For unlocking, the annular push-in and unlocking element 39, which is approximately Z-shaped in a longitudinal section through its wall, is gripped at its gripping projection 24*b* which preferably projects slightly beyond the lower mouthpiece edge 44, and is pulled out to such an extent that the hooking elements 37 are acted on by the inner top edges of the passage windows 21 and are thereby deflected radially slightly. The jet regulator 1*c* which is situated in the mouthpiece 2*b* is then released and can be removed from the mouthpiece 2*b*.

During the insertion of the jet regulator 1*c*, the insertion force is transmitted via the push-in and unlocking element 39 to the annular jet regulator housing 3*d*, with the Z-shaped shoulder 40 resting on the lower edge 50 of the housing 3*d*. The inner end sides both of the push-in and unlocking element 39 and also of the housing 3*d* bear at the lower side against the O-ring groove flange 35 of the jet diffuser 4, such that the latter is likewise driven during the insertion movement until it bears against the inner insert stop 49 of the mouthpiece 2*b*.

At least the hooking elements 37, and if appropriate the entire jet regulator housing 3*d*, may be composed of metal, preferably spring steel.

In the exemplary embodiment, the jet regulator 1*c* is held against the insert stop 49 within the mouthpiece 2*b*. It is however also possible to provide a connection between the jet diffuser 4 and the housing 3*d* by interlocking the housing, by means of latching elements, to the jet diffuser. It is possible to dispense with interlocking of the two parts or with an insert stop if the jet diffuser 4 and the housing are produced as a hybrid component from plastic and metal.

FIGS. 22 to 29 illustrate a jet regulator 1 which has a jet regulator housing 3 with insert parts situated therein. It is clear from FIGS. 22 to 29 that, here, a jet diffuser 4 with an ancillary sieve 5 which is connected upstream at the inflow side is provided in the jet regulator housing 3. The jet regulator housing 3 of the jet regulator 1 shown in FIGS. 22 to 29 can be inserted by means of an axial-push in movement into the water outlet 2 of a sanitary water outlet fitting.

In FIG. 22, it is indicated that the jet regulator housing 3 can be inserted directly into the tubular outlet end of an outlet fitting which is adapted to the jet regulator 1, or mounted on a commercially available outlet fitting with the aid of an adapter mouthpiece 2' which is associated with the jet regulator. While the left-hand half of the drawing in FIG. 22 illustrates a water outlet 2 which is designed as an outlet end of an outlet fitting which is specifically adapted to the jet regulator 1, the right-hand half of the drawing in FIG. 22 illustrates an adapter mouthpiece 2' which can be fastened by means of an internal or—as is the case here—external thread 30 to the outlet end of a commercially available outlet fitting, and which can hold the jet regulator 1.

The jet regulator housing 3 has a retainer 6 for connecting to the water outlet 2. For this purpose, the retainer 6 has a plurality of spring elements 9 which are arranged in a paired fashion on opposite sides of the jet regulator housing 3 and which, at their free ends which are aligned obliquely outward, support in each case one latching projection 10. The retainer 6 is of crown-like design and has an annular gripping projection 60 from which the spring elements 9 project. The spring elements 9 are guided in an axially movable manner in housing pockets 63 of the jet regulator housing 3. Said housing pockets 63 are designed to be open at both sides and have two housing pocket openings 62, 71, of which a first housing pocket opening 71 is provided at the outflow-side end edge of the jet regulator housing 3 and a second housing pocket opening 62 is provided at the housing outer periphery.

In FIGS. 24 and 25, it can be seen that, as the jet regulator housing 3 is pushed axially into the water outlet 2, the spring elements 9 bear, with the latching projections 10 which are provided at the free spring element ends, against the inner periphery of the water outlet 2' until said latching projections latch into a depression which is provided on the inner periphery of the water outlet 2' and which is designed here as an encircling annular groove 13. In the functional position, which is now explained in more detail below and in FIGS. 26 and 27, the jet regulator housing 3 moves, at the inside, past the spring arm ends, which support the latching projections 10 in the direction of the water outlet 2', until the inflow-side opening edge 61 of the peripheral housing pocket openings 62 acts on and supports the free end region of the spring elements 9, at their side remote from the latching projections 10, in such a way that the latching projections 10, which also continue to project over the housing pocket openings 62, are secured in the annular groove 13 of the water outlet 2'. It is a particular advantage of the jet regulator 1 shown in FIGS. 22 and 29 that the opening edge 61, which serves as a locking element 8, of the housing pocket openings 62 is pressed more intensely against the spring elements 9 with increasing water pressure, and that as a result, under the pressure of the inflowing water, a self-reinforcing jamming action of the spring elements 9 in the functional position of the jet regulator 1 is produced.

If the jet regulator 1 is to be removed from the water outlet 2' on demand at a given time, the locking of the jet regulator housing 3 in the water outlet 2' can be released merely by exerting finger pressure on the jet regulator housing 3. As shown in FIGS. 28 and 29, a relative movement takes place here of the jet regulator housing 3 on the one hand and the spring element 9, or the inner periphery of the water outlet 2', on the other hand, which relative movement brings about a movement of the spring elements 9, which are guided in the housing pockets 63, in such a way that the latching projections 10 which are provided on the spring elements 9 are moved into an unlocking position in which they are retracted radially inward into the housing pockets 63. Here, the spring elements 9 are flattened into the housing pockets 63 and their free end region is acted on by the outflow-side opening edge 64 of the housing pocket openings 62 in such a way that, with the spring element ends, the latching projections 10 which are provided on said spring element ends also move radially inward. In said unlocking position, the latching projections 10 pass out of engagement with the annular groove 13, such that the jet regulator 1 together with its jet regulator housing 3 can be moved out of the water outlet 2' for example by the pressure of the inflowing water.

The jet regulator designs shown in FIGS. 1 to 29 can be mounted and dismounted in a simple manner without tools. In regions which are accessible to the general public, it may however be expedient if the jet regulator 1 is arranged in the water outlet 2, 2' so as to be protected from vandalism and theft, without the mounting and dismounting of the jet regulator 1 being made significantly more complex as a result.

The jet regulator alternative illustrated in FIGS. 30 to 35 therefore shows a jet regulator 1 which is assigned an unlocking tool 65 which is illustrated in more detail in FIGS. 31 to 35. The jet regulator 1 also has a jet regulator housing 3 with insert parts situated therein. It can for example be seen in FIG. 30 that a jet diffuser 4 is situated in the jet regulator housing 3, with an ancillary sieve 5 being connected upstream of said jet diffuser 4 at the inflow side.

The jet regulator housing 3 of the jet regulator 1 shown in FIGS. 30 to 35 can likewise be inserted by means of an axial push-in movement into the water outlet 2 of an outlet fitting (not illustrated in any more detail). For this purpose, the jet regulator 1 has, on its jet regulator housing 3, a retainer 6 with at least one radially movable projection 10 which is designed for connecting to the water outlet 2. Provided as part of said latching retainer 6 are a plurality of spring elements 9 which, at their free ends, support outwardly pointing latching projections 10. Said spring elements 9 are preferably distributed uniformly over the outer periphery of the jet regulator housing 3, with it being possible for the spring elements 9 to be assigned to one another in a paired fashion and to be situated diametrically opposite one another. The spring elements 9 of the jet regulator 1 illustrated in FIGS. 30 to 35 are aligned with their free end regions in the direction of the inflow side of the jet regulator 1. The latching projections 10, which are initially still radially deflected during the axial push-in movement, engage into an annular groove 13, which forms a depression, on the water outlet 2 once the jet regulator 1 has reached its functional position.

Figure 34:
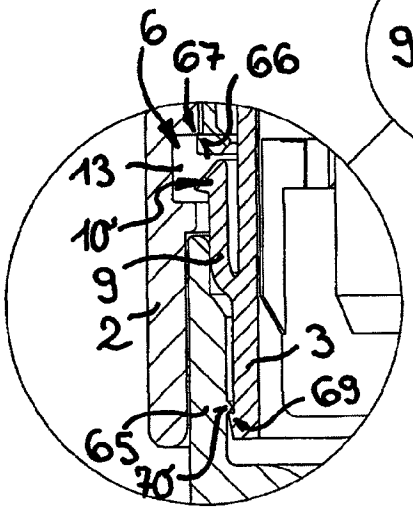
FIG. 34 shows the jet regulator as per FIGS. 30 to 33 in a detailed longitudinal section from FIG. 33 in the region of the retainer.

It can be seen in the detailed illustration of FIG. 34 that an annular, encircling stop 66 is provided on the outer periphery of the jet regulator housing 3 above the spring elements 9 in the push-in direction, which stop 66 interacts with a counterstop 67, which is designed as an annular shoulder, on the inner periphery of the water outlet 2, and which stop 66 limits the axial push-in movement of the jet regulator housing 3.

If the jet regulator 1 is to be removed from the water outlet 2 again on demand at a given time, it is necessary to use the unlocking tool 65. From a comparison of FIGS. 32 and 33, it is clear that said unlocking tool 65 can be inserted by means of an axial push-in movement into the annular space 68 which is provided between the water outlet inner periphery and the housing outer periphery. Here, the axial push-in movement of the unlocking tool 65 is converted into a radial movement of the latching projections 10 into the unlocking position once that end edge of the sleeve-shaped unlocking tool 65 which faces toward the jet regulator housing 3 has reached the spring elements 9, which support the latching projections 10, and presses said spring elements 9 inward. The unlocking tool 65 encloses the jet regulator housing 3 and the spring elements 9, which are elastically integrally formed thereon, such that the spring elements 9 with the latching projections 10 provided thereon are retracted within the circular envelope defined by the greatest housing diameter of the jet regulator housing 3, and the latching projections 10 pass out of engagement with the jet regulator housing 3.

In the detailed illustration in FIG. 34, it can be seen that the jet regulator housing 3 and the unlocking tool 65 can be detachably latched to one another. For this purpose, a hook-shaped and annularly encircling projection 69 is provided on the jet regulator housing 3, which projection 69 can engage behind a likewise annularly encircling projection 70 on the inner periphery of the sleeve-shaped unlocking tool 65. If the unlocking tool 65 and the jet regulator housing 3 are latched to one another, the spring elements 9 are also situated in their unlocked position, such that the jet regulator housing 3 together with the jet regulator 1 can be comfortably removed from the water outlet 2.

Figure 35:
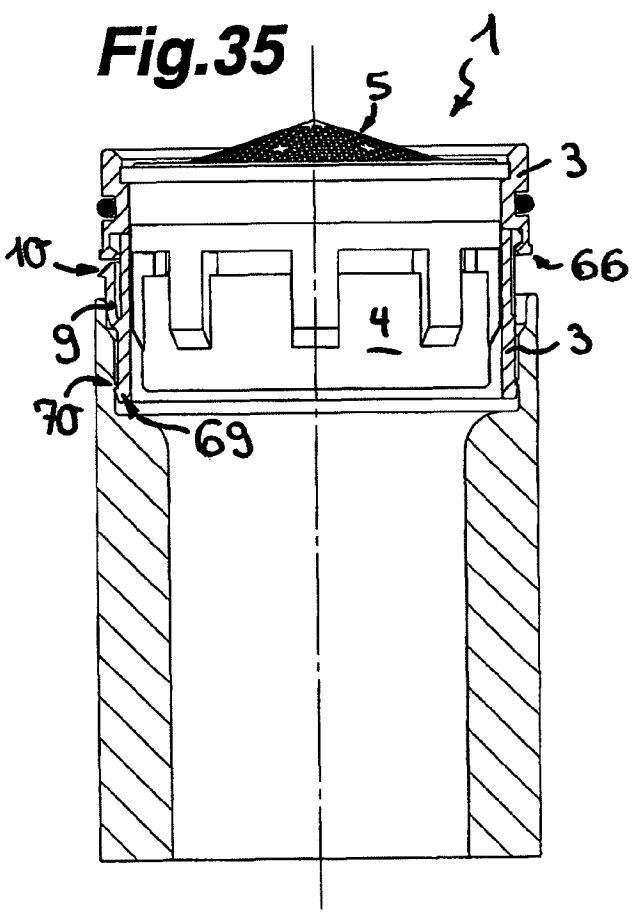
FIG. 35 shows the jet regulator from FIGS. 30 to 34 dismounted from the water outlet and still situated on the unlocking tool.
Figure 33:
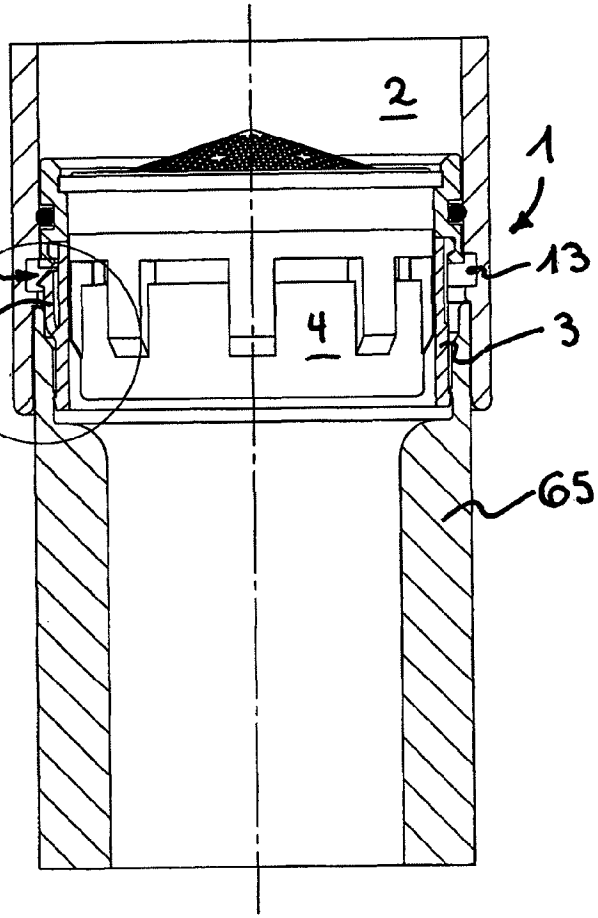
FIG. 33 shows the jet regulator still situated in the water outlet, with the unlocking tool already having been pushed, for the purpose of dismounting the jet regulator, into the annular space which is provided between the water outlet inner periphery and the housing outer periphery.

As can be seen from FIG. 35, the inflow-side partial region of the jet regulator housing 3, which is detachably latched to the unlocking tool 65, projects over the unlocking tool 65 such that the jet regulator housing 3 can be gripped at said projecting partial region and the latching connection can be released by means of the unlocking tool 65.

The invention claimed is:

1. A sanitary outlet fitting comprising a water outlet (2*a*) and a jet regulator (1) which is assigned to the water outlet (2*a*), the jet regulator has a jet regulator housing with insert parts situated therein, the jet regulator housing (3) is insertable by an axial push-in movement into the water outlet (2*a*), and has a retainer (6) with at least one radially movable projection for connecting to the water outlet (2*a*), a locking element (8, 8*a*), which is axially actuatable from outside without using tools, is provided for selectively securing and releasing the retainer (6), wherein the jet regulator housing (3*b*, 3*c*) has on an inlet side end (34) on which an installation part (4) rests, spring elements (9*a*) with outwardly projecting latching projections (10*a*) for direct engagement into an annular groove (13*a*) of the water outlet of the outlet fitting, wherein the spring elements (9*a*) with the latching projections (10*a*) are integrally connected, with a side facing away from an outflow side of the jet regulator, to a housing wall of the jet regulator, and are separated from the adjoining housing wall by lateral slots (45), and wherein the jet regulator housing and the spring elements (9*a*) with the latching projections (10*a*) have, at the outflow side, a flange-like, outwardly pointing gripping projection (24*a*), wherein spring element connected parts of the gripping projection (24*a*) are separated from the housing wall via the lateral slots (45) with the spring elements (9*a*) so that the spring element connected parts of the gripping projection (24*a*) are adapted to be pressed inwardly by finger pressure to radially deflect the locking projections (10*a*).

2. The outlet fitting as claimed in claim 1, wherein the water outlet (2*a*) is designed as an adapter mouthpiece, or mouthpiece, which can be detachably connected to an outlet fitting.

3. The outlet fitting as claimed in claim 1, wherein two diametrically opposite spring elements (9*a*) with the latching projections (10*a*) are provided.

4. The outlet fitting as claimed in claim 1, wherein the latching projections (10*a*) are arranged with their latching surfaces (32) spaced apart from an outflow-side edge (33) of the jet regulator housing (3*b*) and from the gripping projection (24*a*).

5. The outlet fitting as claimed in claim 1, wherein the jet regulator housing (3*b*) has at least one inwardly projecting positioning cam (36) for a jet diffuser (4) which is to be inserted as the installation part.

* * * * *